US007073706B2

(12) United States Patent
Yaginuma et al.

(10) Patent No.: US 7,073,706 B2
(45) Date of Patent: Jul. 11, 2006

(54) PUNCHING DEVICE, SHEET PROCESSOR HAVING THE PUNCHING DEVICE, AND IMAGE FORMING APPARATUS HAVING THE PUNCHING DEVICE

(75) Inventors: Masatoshi Yaginuma, Ibaraki (JP); Shigeru Sugita, Saitama (JP); Yuji Morishige, Ibaraki (JP); Yasuo Fukazu, Chiba (JP); Mitsushige Murata, Chiba (JP); Kiyoshi Okamoto, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 144 days.

(21) Appl. No.: 10/091,464

(22) Filed: Mar. 7, 2002

(65) Prior Publication Data

US 2002/0129690 A1 Sep. 19, 2002

(30) Foreign Application Priority Data

Mar. 13, 2001 (JP) ..... 2001-071189

(51) Int. Cl.
*B26F 1/04* (2006.01)

(52) U.S. Cl. ..... 234/97; 83/549; 83/687; 234/96

(58) Field of Classification Search ..... 83/200, 83/628, 620, 549, 618, 927, 687, 691; 29/898.056, 29/34 R; 234/97–98, 42–43, 94, 101, 106
See application file for complete search history.

(56) References Cited

U.S. PATENT DOCUMENTS

| | | | | |
|---|---|---|---|---|
| 3,547,334 | A * | 12/1970 | Gwyn, Jr. | 228/3.1 |
| 4,833,958 | A * | 5/1989 | Abildgaard et al. | 83/154 |
| 5,463,922 | A | 11/1995 | Mori | |
| 5,761,600 | A | 6/1998 | Murata | |
| 6,065,379 | A | 5/2000 | Shinno et al. | |
| 6,219,503 | B1 | 4/2001 | Miyake et al. | |
| 6,353,726 | B1 | 3/2002 | Murata et al. | |
| 6,371,472 | B1 | 4/2002 | Miyake et al. | |
| 6,622,908 | B1 * | 9/2003 | Fukumoto et al. | 234/98 |
| 2001/0011492 | A1 * | 8/2001 | Fukumoto et al. | 83/549 |

FOREIGN PATENT DOCUMENTS

| | | |
|---|---|---|
| EP | 0 067 973 A2 | 5/1982 |
| GB | 720943 | 12/1954 |
| JP | 10-249796 | 9/1998 |
| JP | 2001-009791 | 1/2001 |

* cited by examiner

*Primary Examiner*—Kenneth E. Peterson
*Assistant Examiner*—Phong Nguyen
(74) *Attorney, Agent, or Firm*—Fitzpatrick, Cella, Harper & Scinto

(57) ABSTRACT

There is provided a punching device including: a die member having a plurality of die holes formed therein; a plurality of punch members which are caused to advance into the die holes to punch holes in a member to be punched; an operating member having cam portions formed along a direction intersecting the direction of advancement of the punch members, the operating member being moved along the direction intersecting the direction of advancement of the punch members to cause by a conversion function of the cam portions the punch members to advance into the die holes; and a drive unit for selectively causing advancement of the plurality of punch members by changing the direction of movement of the operating member. In the punching device, each of the cam portions has a straight groove and a cam groove for performing the conversion function, and when the operating member is moved in one of opposite directions, at least one of the cam grooves of the cam portions acts on one of the punch members to selectively cause the same to advance.

19 Claims, 12 Drawing Sheets

FIG. 10

| | | CAM MEMBER AREA DETECTION SENSOR | | | |
|---|---|---|---|---|---|
| | | OFF | | ON | |
| CAM MEMBER MOVEMENT DIRECTION DETECTION SENSOR | OFF | MOVE TO (4) | | MOVE TO (4) | |
| | ON | CAM MEMBER HP SENSOR | | CAM MEMBER HP SENSOR | |
| | | OFF | ON | OFF | ON |
| | | MOVE TO (1) | MOVE TO (7) | MOVE TO (7) | MOVE TO (7) |

PUNCHING DEVICE, SHEET PROCESSOR HAVING THE PUNCHING DEVICE, AND IMAGE FORMING APPARATUS HAVING THE PUNCHING DEVICE

BACKGROUND OF THE INVENTION

1. Field of the Invention

The present invention relates to a punching device for punching holes in a thin member, e.g., a board or a plate such as a wooden board or an iron plate, or a sheet of some material, a sheet processor having the punching device provided in its main body, and an image forming apparatus also having the punching device provided in its main body.

2. Related Background Art

Conventionally, punching devices have been used singly or as a component in a state of being incorporated in an apparatus with which a thin member to be punched is handled.

For example, an application of a punching device in a sheet processor for binding or folding punched sheets is known. The punching device is used in a state of being incorporated in the main body of the sheet processor. An application of a punching device in an image forming apparatus such as a copying machine, a laser beam printer, a facsimile machine, or a combination of some of these apparatuses is known. The punching device is used as a component in a state of being incorporated in a main body of the image forming apparatus. Further, in some cases, a punching device is used in a state of being incorporated in a sheet processor and incorporated in a main body of an image forming apparatus together with the sheet processor.

A punching device used to make holes in a member has the number of punches and the same number of dies corresponding to a certain number of holes which should be made in the member by punching. The punching device punches holes in the member by causing each punch to advance into the hole in the corresponding die.

Conventional punching devices, however, have a complicated mechanism for operating each punch and are therefore incapable of punching holes in a member smoothly and quickly.

In recent years, there has been an increasing demand for changing the number of holes to be punched in a member in accordance with the size thereof. It is not possible to satisfy the demand by using any of the conventional punching devices since each conventional punching device has only punches and dies corresponding to the number of holes to be punched in a member.

SUMMARY OF THE INVENTION

The present invention has been made in view of the above, and an object of the present invention is to provide a punching device capable of smoothly punching holes and changing the number of holes to be punched and, in particular, capable of quickly changing the number of holes to be punched, a sheet processor having the punching device, and an image forming apparatus having the punching device.

In order to achieve the above-mentioned object, one aspect of the present invention relates to a punching device, comprising:

a die member having a plurality of die holes formed therein;

a plurality of punch members which are caused to advance into the die holes to punch holes in a member to be punched;

an operating member having cam portions formed along a direction intersecting the direction of advancement of the punch members, the operating member being moved along the direction intersecting the direction of advancement of the punch members to cause by a conversion function of the cam portions the punch members to advance into the die holes; and drive means for selectively causing advancement of the plurality of punch members by changing the direction of movement of the operating member.

In a punching device according to another aspect of the invention, each of the cam portions has a straight groove and a cam groove for performing the conversion function, and when the operating member is moved in one of opposite directions, at least one of the cam grooves of the cam portions acts on one of the punch members selectively to cause the same to advance.

In a punching device according to another aspect of the invention, one of the cam portions has two cam grooves at its center, and straight grooves formed at opposite ends of each cam groove, and is used to control two of the punch members.

In a punching device according to another aspect of the invention, one of the cam portions has one cam groove at its center, and straight grooves formed at opposite ends of the cam groove, and is used to control two of the punch members.

In a punching device according to another aspect of the invention, one of the cam portions has one cam groove at its end, and a straight groove formed at an end of the cam groove, and is used to control one of the punch members.

In a punching device according to another aspect of the invention, one of the cam portions has two cam grooves at its center, and straight grooves formed at opposite ends of each cam groove, and is used to control two of the punch members; another of the cam portions has one cam groove at its center, and straight grooves formed at opposite ends of the cam groove, and is used to control two of the punch members; and a remaining one of the cam portions has one cam groove at its end, and a straight groove formed at an end of the cam groove, and is used to control one of the punch members, two of the punch members and three of the punch members being selectively caused to advance.

Another aspect of the present invention relates to a punching device, comprising position detection means for detecting the position of the operating member while sectioning the area for movement of the operating member into a first rest area, a first punching area, a second punching area, and a second rest area in the stated order, drive means for moving the operating member, and operation control means for controlling the drive means on the basis of the detection operation of the position detection means, wherein the operating member can be moved between the first rest area and the second rest area, which performs in the first punching area a punching operation for causing the punch member to advance into the corresponding die hole when moved from the first rest area to the second rest area, and performs in the second punching area a punching operation for causing the punch member to advance into the corresponding die hole when moved from the second rest area to the first rest area.

In a punching device according to another aspect of the invention, the operation control means performs an initializing operation for moving the operating member to the second rest area when the operating member is located in the first rest area or in the first punching area, and that for moving the operating member to the first rest area when the operating member is located in the second rest area or in the second punching area.

Another aspect of the present invention relates to a punching device, comprising position detection means for detecting the position of the operating member while sectioning the area for movement of the operating member into a first rest area, a first punching area, a second punching area, a second rest area, a third punching area, a fourth punching area, and a third rest area in the stated order, and operation control means for moving the operating member through a movement area selected from a first movement area formed of the first rest area, the first punching area, the second punching area, and the second rest area, and a second movement area formed of the second rest area, the third punching area, the fourth punching area, and the third rest area by controlling the drive means on the basis of the detection operation of the position detection means, wherein the operating member punches a first number of holes in the member to be punched with the corresponding number of the punches when the operating member performs in the first punching area a punching operation for causing the corresponding number of the punch members to advance into the corresponding die holes during its movement from the first rest area to the second rest area, and when the operating member performs in the second punching area a punching operation for causing the corresponding number of the punch members to advance into the corresponding die holes during its movement from the second rest area to the first rest area, and wherein the operating member punches a second number of holes in the member to be punched with the corresponding number of the punches when the operating member performs in the third punching area a punching operation for causing the corresponding number of the punch members to advance into the corresponding die holes during its movement from the second rest area to the third rest area, and when the operating member performs in the fourth punching area a punching operation for causing the corresponding number of the punch members to advance into the corresponding die holes during its movement from the third rest area to the second rest area.

In a punching device according to another aspect of the invention, the operation control means performs, on the basis of the detection operation of the position detection means, an initializing operation for moving the operating member to the second rest area when the operating member is located in the first rest area or in the first punching area, that for moving the operating member to the first rest area when the operating member is located in the second rest area or in the second punching area, that for moving the operating member to the third rest area when the operating member is located in the second rest area or in the third punching area, and that for moving the operating member to the second rest area when the operating member is located in the third rest area or in the fourth punching area.

In a punching device according to another aspect of the invention, a speed of the movement of the operating member in the initializing operation is lower than that in the punching operation.

In a punching device according to another aspect of the invention, the operation control means stops the operation of the drive means if the position detection means does not detect the movement of the operating member after a lapse of a predetermined period of time from the time at which the operation control means starts the operation of the operating member.

In a punching device according to another aspect of the invention, the predetermined period of time in the case of the initializing operation is longer than that in the case of the punching operation.

In order to achieve the above-mentioned object, the present invention relates to a sheet processor, comprising the punching device for punching holes in the sheet according to any one of the above aspects and binding means for binding the sheets.

In order to achieve the above-mentioned object, the present invention relates to an image forming apparatus, comprising: image forming means for forming an image on a sheet; and the punching device for punching holes in the sheet according to any one of the above aspects.

In order to achieve the above-mentioned object, the present invention relates to an image forming apparatus, comprising: image forming means for forming an image on a sheet; the punching device for punching holes in the sheet according to any one of the above aspects; and binding means for binding the sheets.

The punching device of the present invention is arranged to punch holes in a member to be punched by using the movement of the operating member moved in a direction intersecting the direction of advancement of the punch members. Therefore the punching device simply constructed in accordance with the present invention can quickly punch holes in a member to be punched.

The punching device of the present invention is capable of selectively punching the first number of holes and the second number of holes. Therefore it is possible to punch different numbers of holes in a member to be punched with only one punching device of the present invention.

The punching device of the present invention is arranged to reliably stop the operating member in one of the rest areas by the initializing operation. After initialization, therefore, the operating member can be quickly moved to one of the punching areas with reliability to quickly perform the punching operation with reliability.

BRIEF DESCRIPTION OF THE DRAWINGS

FIGS. 6A, 6B, 6C and 6D are diagrams for explaining two holes punching operation;

FIGS. 6D, 6E, 6F and 6G are diagrams for explaining three holes punching operation;

FIG. 10 is a diagram in matrix form showing destinations for the cam member in the initializing operation of the punching device in the embodiment of the present invention;

DETAILED DESCRIPTION OF THE PREFERRED EMBODIMENT

An image forming apparatus which represents an embodiment of the present invention, which is, typically, a printer, and which includes a punching device and a sheet processor will be described with reference to the accompanying drawings.

The present invention will be described below with respect to a case of punching holes in a sheet. However, the punching device of this embodiment is capable of punching holes a thin member (member which should be punched), e.g., a board or a plate such as a wooden board or an iron plate, or a sheet of some material. Therefore punching with the punching device of the present invention is not limited to punching on a sheet only.

The punching device is used singly or as a portion of an apparatus with which a sheet is handled, i.e., in a state of being incorporated in the apparatus. The apparatus with which a sheet is handled is, for example, a sheet processor for binding or folding punched sheets or an image forming apparatus for forming an image on a sheet. Examples of the image forming apparatus are a copying machine, a laser beam printer, a facsimile machine, and a combination of some of these apparatuses. Examples of sheets punched by the punching device are ordinary paper, an overhead projector sheet, a thin resin sheet used as a substitute for ordinary paper, and a cardboard.

(Copying machine)

A copying machine which is an example of the image forming apparatus incorporating the punching device will be described with reference to FIG. 1.

Figure 1:
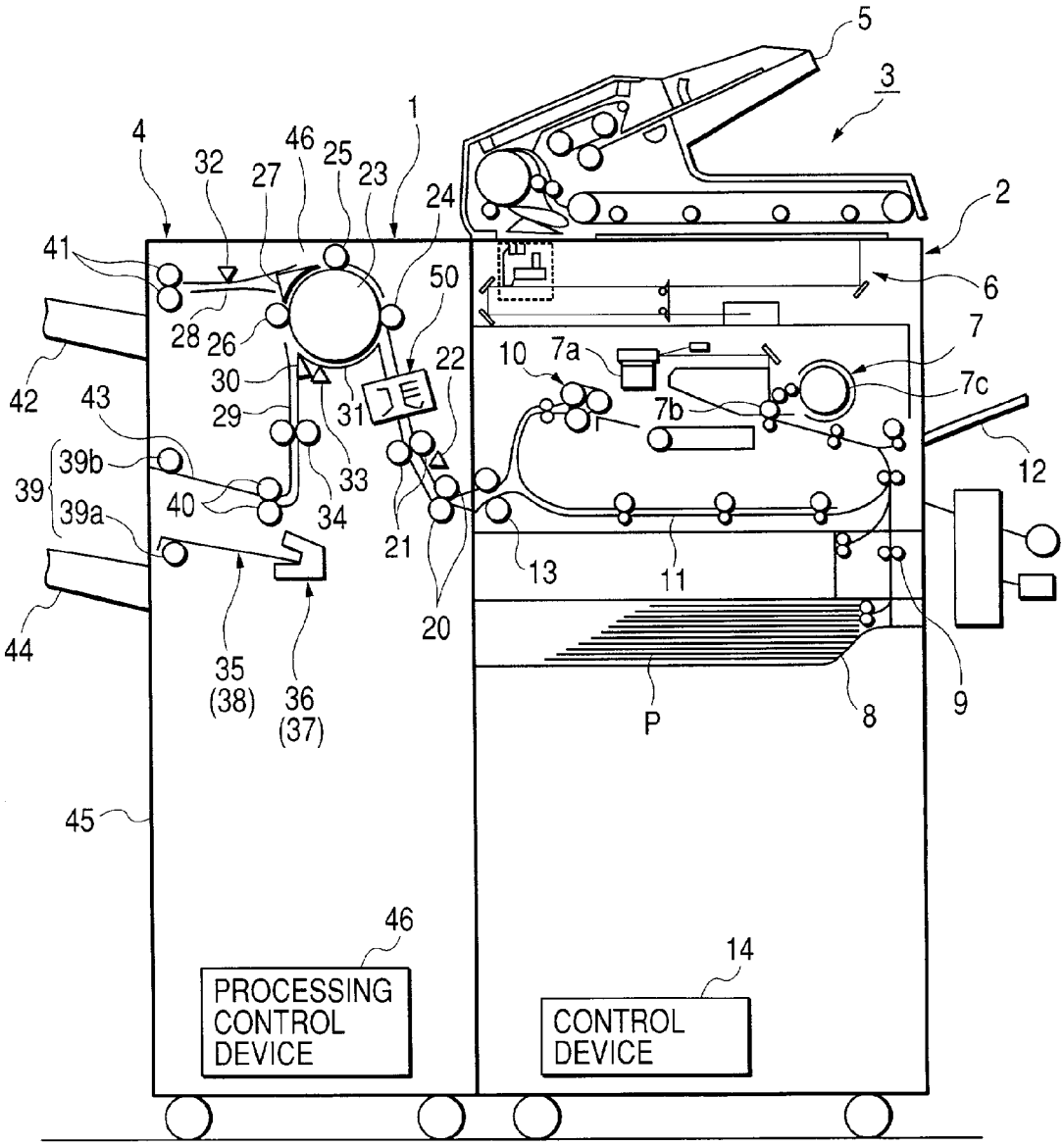
FIG. 1 is a schematic sectional front view of a copying machine which is an image forming apparatus having a sheet processor, and which represents an embodiment of the present invention.

Referring to FIG. 1, a copying machine 3 has a sheet processor 1 connected to a copying machine main unit 2. The sheet processor 1 has a punching device 50 capable of punching holes in a sheet on which an image is formed in the copying machine main unit 2, and a finisher 4 capable of sheet post-processing for binding each of certain numbers of copies.

The copying machine 3 optically reads through an optical portion 6 an original which is automatically fed from an original feeder 5 provided at the top. A digital signal thereby obtained as information on the original is transmitted to an image forming portion (image forming means) 7. An irradiating portion 7*a* irradiates a photosensitive drum 7*b* with laser light to form a latent image on the same. This latent image is developed by a developing device 7*c* to form a toner image.

A plurality of sheet cassettes 8 in which sheets P of various sizes are accommodated are provided in a lower section of the copying machine main unit 2. The toner image is transferred by an electrophotographic process onto a sheet conveyed from one of the sheet cassettes 8 by a pair of conveying rollers 9. The sheet is conveyed to a fixing device 10. The toner image is fixed on the sheet by heat and pressure in the fixing device 10.

If a mode of forming an image on one sheet surface has been selected, the sheet is conveyed to the sheet processor 1. If two images are to be formed on the two surfaces of the sheet, the sheet is conveyed into a reconveying path 11 by a switchback mechanism to be again conveyed to the image forming portion 7, and an image is formed on the other surface of the sheet. Thereafter the sheet is conveyed to the sheet processor 1. A sheet may also be supplied through a manual insertion tray 12. The components of the copying machine main unit 2 are controlled by a control device 14.

(Sheet Processor)

Referring to FIG. 1, a pair of rollers 20 at an entrance of the sheet processor 1 receive sheet P discharged from a pair of discharging rollers 13. The received sheet P is conveyed by a pair of first conveying rollers 21. Passage of sheet P is detected by a sheet detection sensor 22.

Thereafter, a rear end portion of the sheet is punched by the punching device 50, and the sheet is temporarily retained on a roll surface of a buffer roller 23 having a comparatively large diameter by pressing rollers 24, 25, and 26 provided on the periphery of the roller 23, the sheet being pressed against the roller surface by the pressing rollers 24, 25, and 26.

A first switching flapper 27 operates for selection between a non-sort path 28 and a sort path 29. A second switching flapper 30 operates for selection between the sort path 29 and a buffer path 31 for temporarily retaining sheet P.

Sheet P in the non-sort path 28 is detected by a sensor 32. Sheet P in the buffer path 31 is detected by a sensor 33. Sheet P in the sort path 29 is conveyed by a pair of second conveying rollers 34.

A processing tray unit 35 temporarily stacks and jogs sheets P. The processing tray unit 35 has an intermediate tray 38 provided for the purpose of performing stapling processing with stapler 37 in a staple unit (binding means) 36. One of a pair of batch discharging rollers 39, i.e., a lower discharging roller 39*a* on a fixed side in this arrangement, is placed at a discharge end of the intermediate tray 38.

Sheet P is discharged onto the intermediate tray 38 by a pair of first discharging rollers 40 placed at an outlet of the sort path 29. Also, sheet P is discharged onto a sample tray 42 by a pair of second discharging rollers 41 placed at an outlet of the non-sort path 28.

The upper discharging roller 39*b* in the pair of batch discharging rollers 39 is supported on a swingable guide 43. When the swingable guide 43 is swung to a closing position, it is brought into pressure contact with the discharging roller 39*a* to discharge sheet P from the intermediate tray 38 onto a stack tray 44.

A batch stack guide 45 receives trailing-end edges (rear ends as viewed along the batch discharge direction) of a batch of sheets stacked on the stack tray 44 and the sample tray 42. In this embodiment, the batch stack guide 45 also forms part of the casing of the sheet processor 1. The operations of the components of the sheet processor 1 are controlled by a processing control device (operation control means) 46.

(Punching Device)

Figures 2A, 2B, 2C:
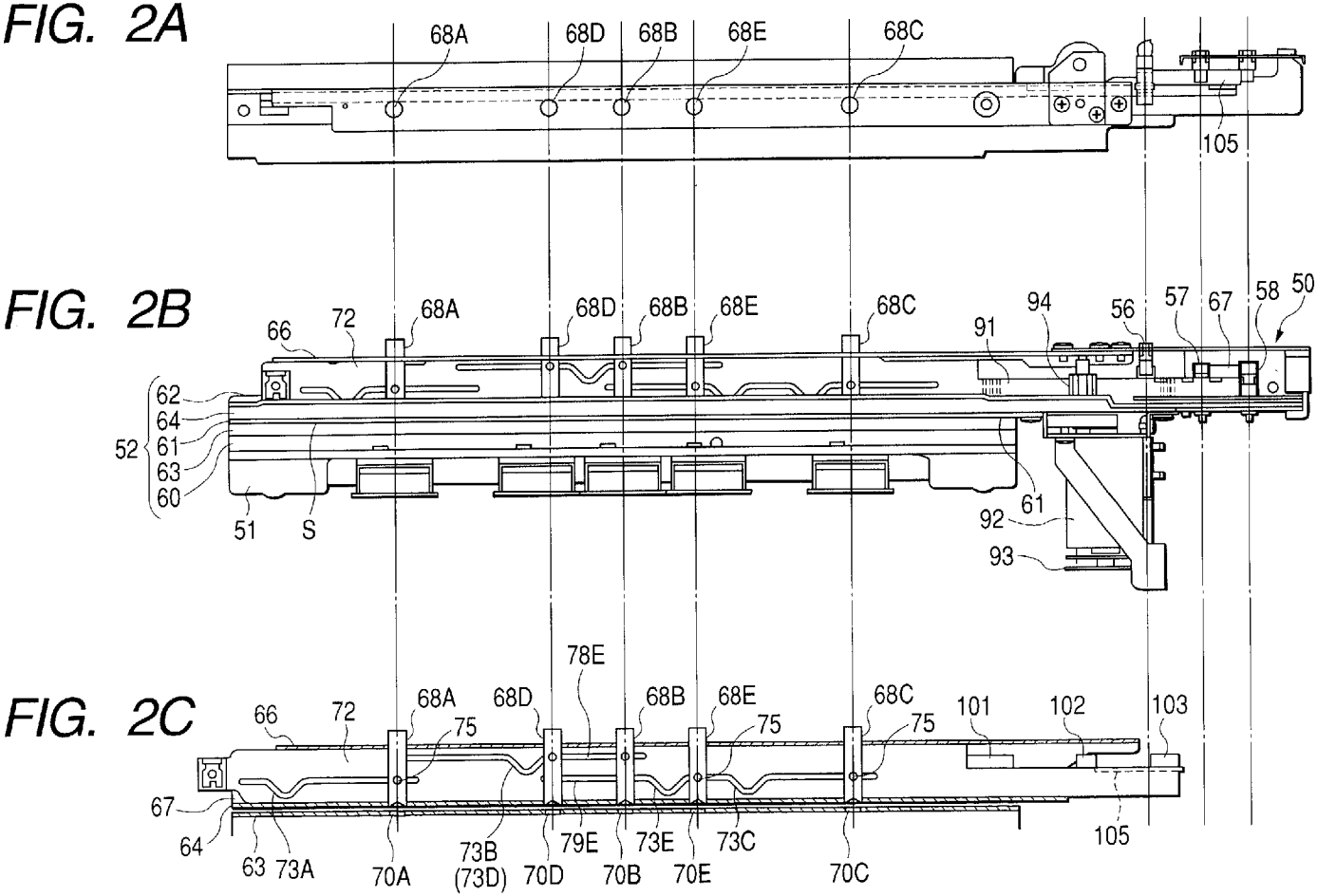
FIG. 2A is a top view of the punching device in the embodiment shown in FIG. 1.
FIG. 2B is a diagram showing a view of the punching device as seen from the sheet conveyance direction upstream side in the embodiment shown in FIG. 1.
FIG. 2C is a cross-sectional view of the punching device taken along a cam member in the embodiment shown in FIG. 1.

The construction of the punching device 50 mounted in the finisher 4 will be described with reference to FIGS. 2A, 2B, and 2C. FIG. 2A is a top view of the punching device 50, FIG. 2B is a diagram showing a view of the punching device 50 as seen from the sheet conveyance direction upstream side, and FIG. 2C is a cross-sectional view taken along a cam member 72. The punching device 50 shown in FIGS. 2A, 2B, and 2C is arranged to selectively punch two or three holes in a sheet.

The punching device 50 has a fixed frame 51 and a movable frame 52 capable of moving on the fixed frame 51 leftward and rightward as viewed in FIGS. 2A, 2B, and 2C. The movable frame 52 includes a lower frame 60 which moves on the fixed frame 51, and an upper frame 62 which is fixed on the upper side of the lower frame 60 with a plurality of spacers 61 interposed therebetween.

Figure 3:
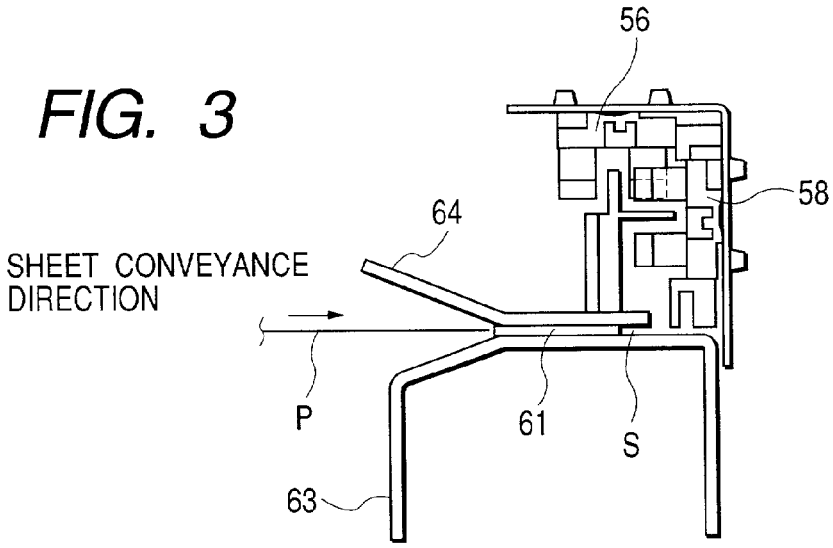
FIG. 3 is a side view as seen from the right-hand side of the punching device shown in FIG. 2B, with some portion removed.
Figure 4:
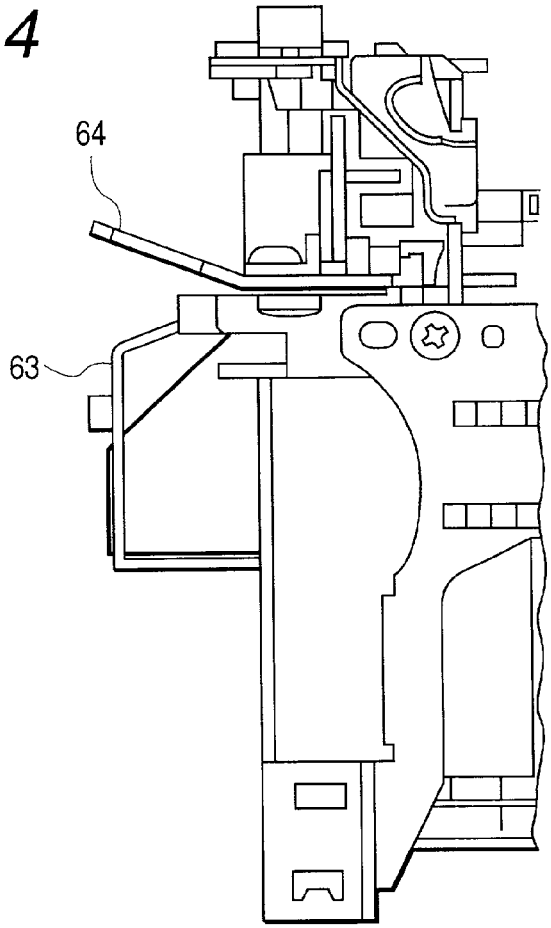
FIG. 4 is a side view as seen from the right-hand side of the punching device shown in FIG. 2B.

The spacers 61 are provided between the lower frame 60 and the upper frame 62 to form a gap S between a top plate 63 of the lower frame 60 and a bottom plate 64 of the upper frame 62 through which a sheet is allowed to pass. The upstream ends of the top plate 63 of the lower frame 60 and the bottom plate 64 of the upper frame 62 are formed so as to be gradually distanced apart from each other, as shown in FIG. 3. The upstream ends of the top plate 63 and the bottom plate 64 thus formed have the function of guiding a sheet into the gap S.

The upper frame 62 has the bottom plate 64, a top plate 66 opposed to the bottom plate 64, and a back plate 67 which connects the bottom plate 64 and the top plate 66. These plates form the shape of a box opened at one side as viewed in cross section. Five punches 68A, 68B, 68C, 68D, and 68E are mounted in the bottom and top plates 64 and 66 so as to be able to move along a vertical direction through the bottom and top plates 64 and 66. Die holes 70A, 70B, 70C, 70D, and 70E for punching holes in a sheet in cooperation with the punches 68A, 68B, 68C, 68D, and 68E are formed in the top plate 63 of the lower frame 60 facing the lower ends of the punches 68A, 68B, 68C, 68D, and 68E. Thus the top plate 63 of the lower frame 60 functions both as a die and as a sheet guide plate.

The punches 68A, 68B, 68C, 68D, and 68E are separated into a group consisting of the punches 68A, 68B, and 68C for punching three holes, arranged at equal intervals in the upper frame 62, and another group consisting of the punches 68D and 68E for punching two holes, disposed between the punches 68A, 68B, and 68C for punching three holes. The punches 68A, 68B, 68C, 68D, and 68E respectively have engaging pins 75 which engage cams 73A, 73B, 73C, 73D, and 73E in a cam member 72, the engaging pins 75 extending perpendicularly from the punches 68A, 68B, 68C, 68D, and 68E.

The cams 73A, 73B, 73C, 73D, and 73E formed in the cam member 72 are separated into a group consisting of the cams 73A, 73B, and 73C for punching three holes, and another group consisting of the cams 73D and 73E for punching two holes. Each of the cams 73A, 73B, 73C, 73D, and 73E is a groove formed of slanted portions slanted in different directions and straight portions extending along the direction of movement of the cam member 72, the slanted portions having their adjacent ends connected smoothly, each slanted portion and one of the straight portions also having their adjacent ends connected smoothly. Since the engaging pins 75 of the punches 68A, 68B, 68C, 68D, and 68E engage the cams 73A, 73B, 73C, 73D, and 73E, the position of each of the punches 68A, 68B, 68C, 68D, and 68E in the axial direction is determined by the position of its pin in one of the cams.

Referring to FIGS. 2A to 2C, the punch 68A in the three-holes-punching punch group engages the cam 73A at the left end in the three-holes-punching cam group. The right straight portion of the cam 73A is formed so as to be longer than the left straight portion. The second cam 73B (73D) from the left is used in three holes punching and also used in two holes punching, and the central punch 68B in the three-holes-punching punch group and the left punch 68D in the two-holes-punching punch group engage the cam 73B (73D). The arrangement in which the cam 73B (73D) is used in common with the two punches 68B and 68D has the effects of reducing the number of cams and reducing the distance between the punches 68B and 68D. The third cam 73E from the left used in two holes punching and the fourth cam 73C from the left used in three holes punching have their straight portions formed continuously with each other. The right punch 68E used in two holes punching engages the third cam 73E from the left used in two holes punching. The right punch 68C used in three holes punching engages the fourth cam 73C from the left used in three holes punching. The outer straight portions of these two cams 73E and 73C extend away from each other.

In the above-described cams, the length of the right straight portion of the left-end cam 73A used in three holes punching, the length of the right and left straight portions of the second cam 73B (73D) from the left used in three holes punching and in two holes punching, the length of the left straight portion 79E of the third cam 73E from the left used in two holes punching, and the length of the right straight portion of the fourth cam 73C from the left used in three holes punching are set to values substantially equal to each other. The left cam 73A used in three holes punching, the third cam 73E from the left used in two holes punching, and the fourth cam 73C from the left used in thee hole punching are formed at the same height. The second cam 73B (73D) from the left used in three holes punching and in two holes punching is formed at a height higher than that of the other three cams, as viewed in FIG. 2B or 2C.

Therefore, the end of the right straight portion of the left cam 73A used in three holes punching and the end of the left straight portion of the second cam 73B (73D) from the left used in three holes punching and in two holes punching can be formed in such positions as to face each other in the vertical direction as viewed in FIG. 2B or 2C. Also, the entire right straight portion 78E of the second cam 73B (73D) from the left used in three holes punching and in two holes punching and the entire left straight portion of the third cam 73E from the left used in two holes punching can be formed generally in such positions as to face each other. Thus, the punches 68A, 68B, 68C, 68D, and 68E can be disposed by setting standard distances therebetween.

Since the positions of the cams 73A, 73B, 73C, 73D, and 73E are shifted along the direction of movement of the punches 68A, 68B, 68C, 68D, and 68E to separately form the cams, it can be avoided that the unnecessary punches are operated.

Further, while the punches 68A, 68B, and 68C are disposed at equal intervals, the distance between the left cam 73A used in three holes punching and the second cam 73B (73D) from the left used in three holes punching and in two holes punching and the distance between the cam 73B (73D) and the fourth cam 73C from the left used in three holes punching are different from each other. Also, the distance between the punches for three holes punching and the corresponding distance between the cams for three holes punching are different from each other. Similarly, the distance between the punches 68D and 68E for two holes punching and the distance between the cams 73D and 73E for two holes punching are different from each other. The distances between the cams and the distances between the punches are varied as described above in order that the three punches for three holes punching or the two punches for two holes punching operate successively with a time lag to punch holes in a sheet as the cam member 72 is moved to perform three holes punching or two holes punching with the punches. As a result, a cam member drive motor 92 described below can smoothly operate for punching without any excessive load imposed thereon.

A rack 91 is formed in a right end portion of the cam member 72. A pinion 94, which is rotated by the cam member drive motor 92 provided on the movable frame 52, meshes with the rack 91.

Three punching state detection flags (position detection means) 101, 102, and 103 are formed on the right end portion of the cam member 72 so as to project upward. A cam member home position detection sensor (position detection means) 56 for detecting each of the three punching state detection flags 101, 102, and 103 is provided on the top plate 66 of the upper frame 62. The three punching state detection flags 101, 102, and 103 and the cam member home position detection sensor 56 are arranged to detect whether two or three of the punches 68A, 68B, 68C, 68D, and 68E are punching holes in a sheet. Hereinafter, a home position will be referred to as "HP".

A cam member state detection flag (position detection means) 105 is formed on the right end portion of the cam member 72 so as to project horizontally. A cam member movement direction detection sensor (position detection means) 57 and a cam member area detection sensor (position detection means) 58 for detecting the cam member state detection flag 105 are mounted on the back side plate 67 of the upper frame 62 in a state of being distanced apart from each other along the direction of movement of the cam member 72.

The cam member area sensor 58 detects the presence/absence of the cam member state detection flag 105 at its detection point. According to the result of this detection, determination is made as to whether the cam member 72 is in an area in which it operates the punches for three holes punching or in an area in which it operates the punches for two holes punching.

The cam member movement direction sensor 57 also detects the presence/absence of the cam member state detection flag 105 at its detection point. According to the result of this detection, the direction in which the cam member 72 is driven is determined when the cam member 72 is operated to move two or three of the punches 68, 68B, 68C, 68D, and 68E for punching.

(Controller)

Figure 5:
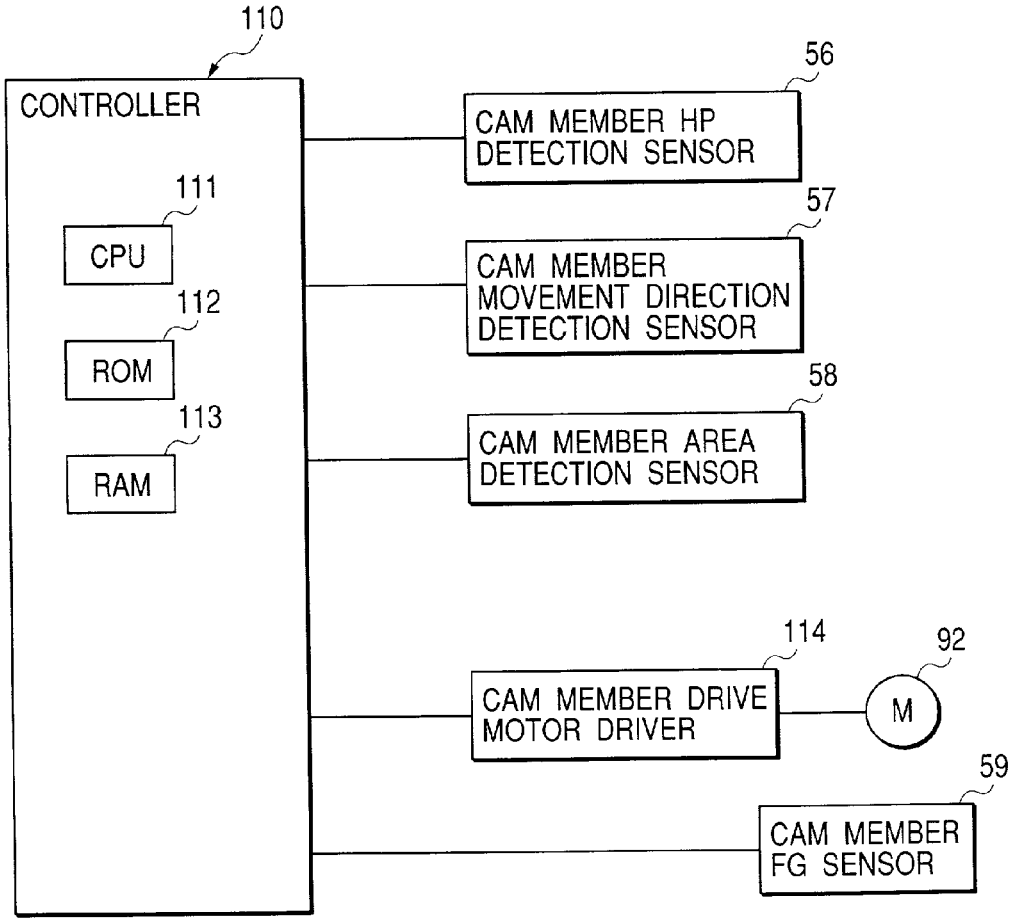
FIG. 5 is a diagram showing the configuration of a controller for controlling the punching device.

The configuration of a controller 110 for controlling the punching device 50 mounted in the finisher 4 will be described with reference to FIG. 5. The controller 110 is provided in the processing control device 46 shown in FIG. 1, and incorporates a central processing unit (CPU) 111, a read-only memory (ROM) 112, and a random-access memory (RAM) 113. The controller 110 performs overall control of the punching device 50 on the basis of a control program stored in the ROM 112. The RAM 113 is used as a working area for temporarily holding control data and for arithmetic processing involved in control processing.

The cam member HP detection sensor 56, the cam member movement direction sensor 57, and the cam member area detection sensor 58 are connected to the controller 110.

Signals representing the results of sensing by these sensors 56, 57 and 58 are input to the controller 110 to be used for control of the punching device 50. The cam member drive motor 92 is a drive source for reciprocating the cam member 72 of the punching device 50 in the horizontal direction to punch holes in a sheet.

A driver 114 controls the cam member drive motor 92 according to a control signal from the controller 110. A cam member FG sensor 59 is a sensor for detecting slits in a slit disk 93 attached to a rotating shaft of the cam member drive motor 92. A signal representing the result of sensing by the cam member FG sensor 59 is input to the controller 110. From this signal, the controller 110 computes the number of revolutions of the cam member drive motor 92 and the moving distance of the cam member 72.

(Explanation of Operation)

FIGS. 6A through 6G are diagrams showing the state of the operation of the cam member 72. FIG. 7 is a diagram showing the logical ON/OFF states of the cam member HP detection sensor 56, the cam member movement direction sensor 57, and the cam member area detection sensor 58 relating to the state of the operation of the cam member 72.

The punching operation of the punching device 50 will now be described.

Figure 8:
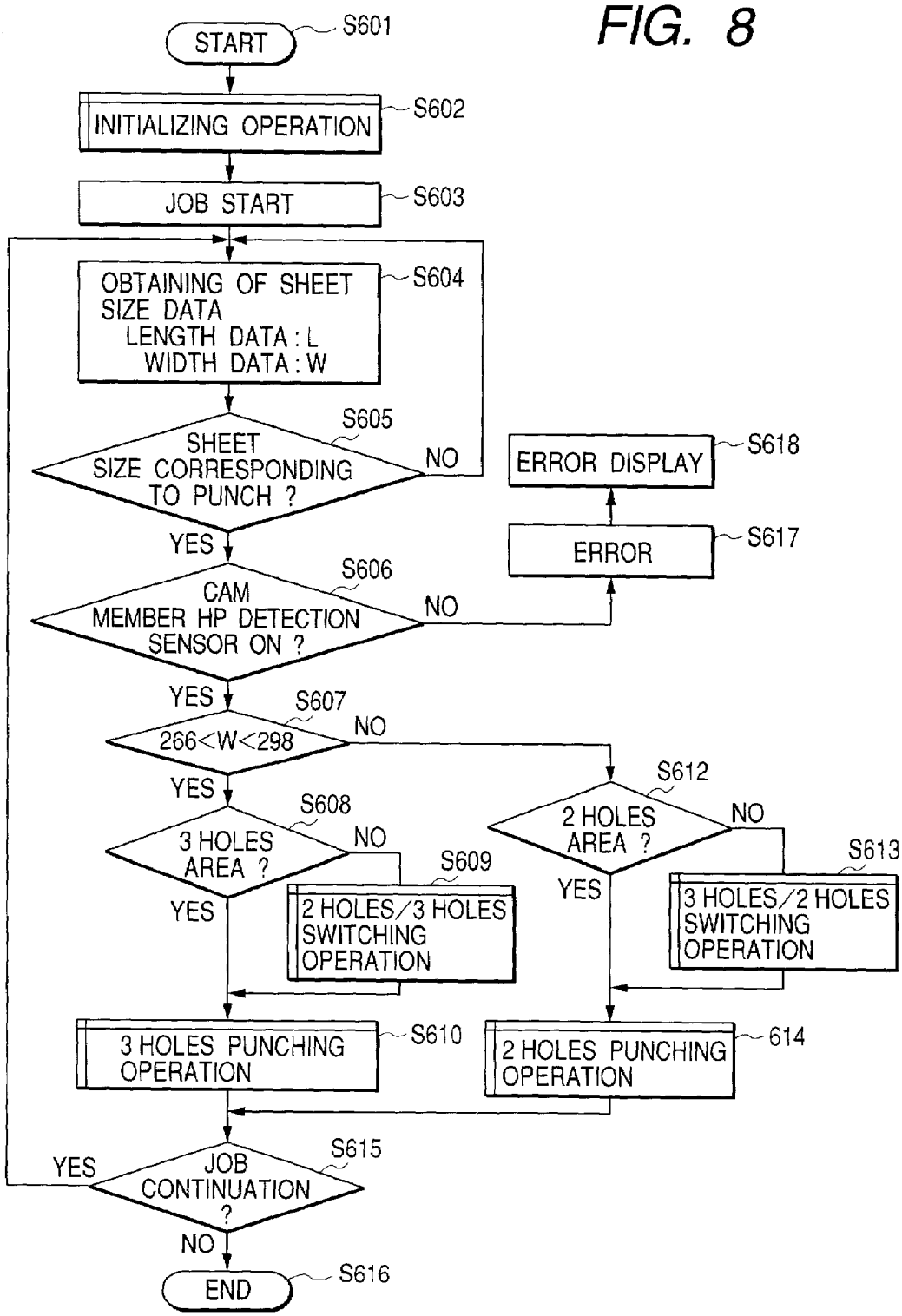
FIG. 8 is a flowchart of the operation of the punching device in the embodiment of the present invention.

Referring to FIG. 8, which is a flowchart for explaining the operation of the punching device 50, a control signal for starting the operation is transmitted from the control device 14 (see FIG. 1) in the copying machine main unit 2 to the processing control device 46 for controlling the punching device 50 (S601). The controller 110 in the processing control device 46 for controlling the punching device 50 then executes an operation for initializing the punching device 50 (S602).

(Explanation of Initializing Operation)

Figure 9:
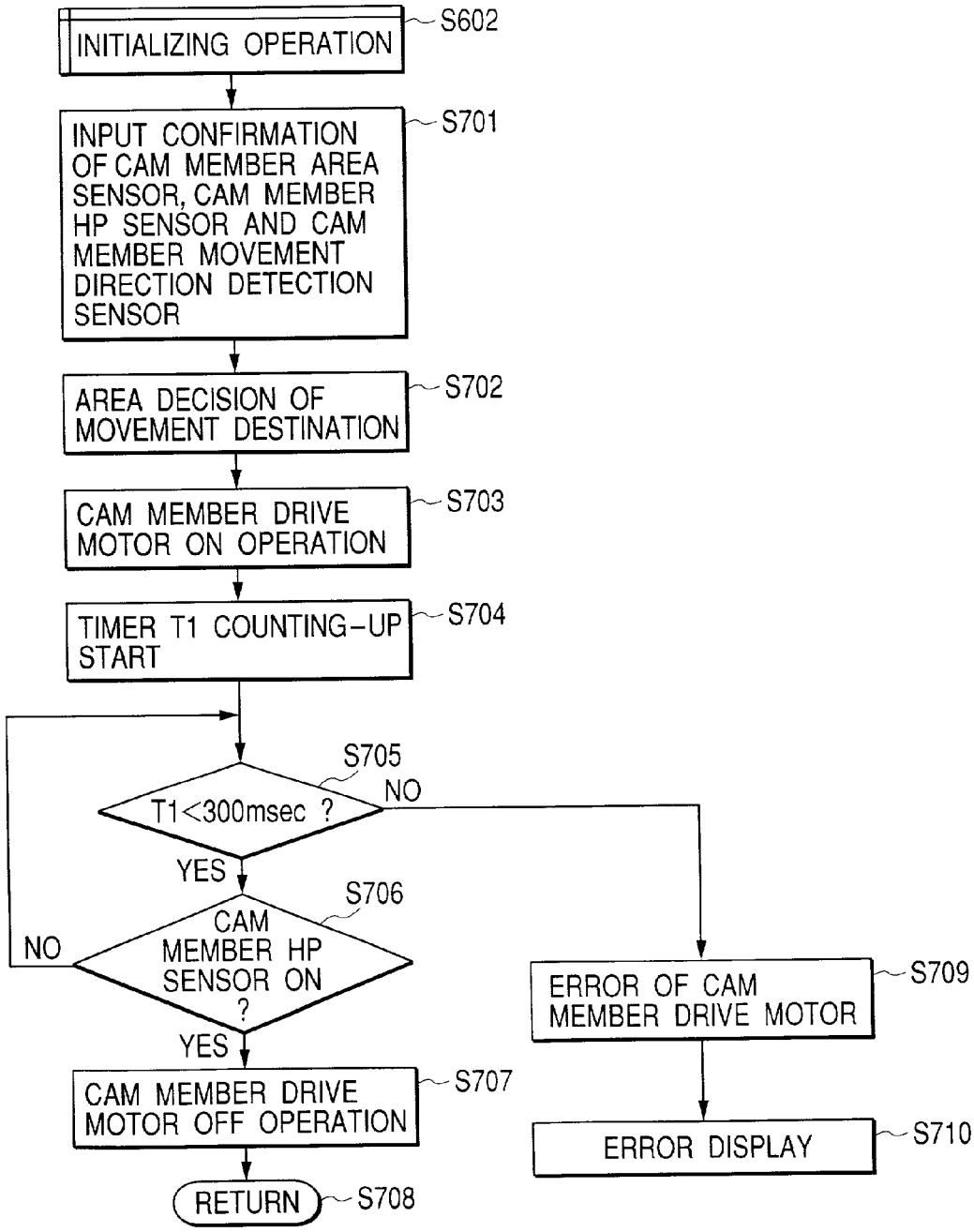
FIG. 9 is a flowchart of an initializing operation of the punching device in the embodiment of the present invention.

FIG. 9 is a flowchart for explaining the initializing operation of the punching device.

This initializing operation is an operation for setting the cam member in a home position to reliably perform the punching operation. When the initializing operation is started (S602), the controller 110 in the processing control device 46 for controlling the punching device 50 checks the states (ON/OFF) of inputs from the cam member HP detection sensor 56, the cam member movement direction detection sensor 57, and the cam member area detection sensor 58. From the states of the signal inputs from these sensors, the controller 110 identifies one of areas in which the cam member 72 is located.

Figures 6A, 6B, 6C, 6D, 6E, 6F, 6G:
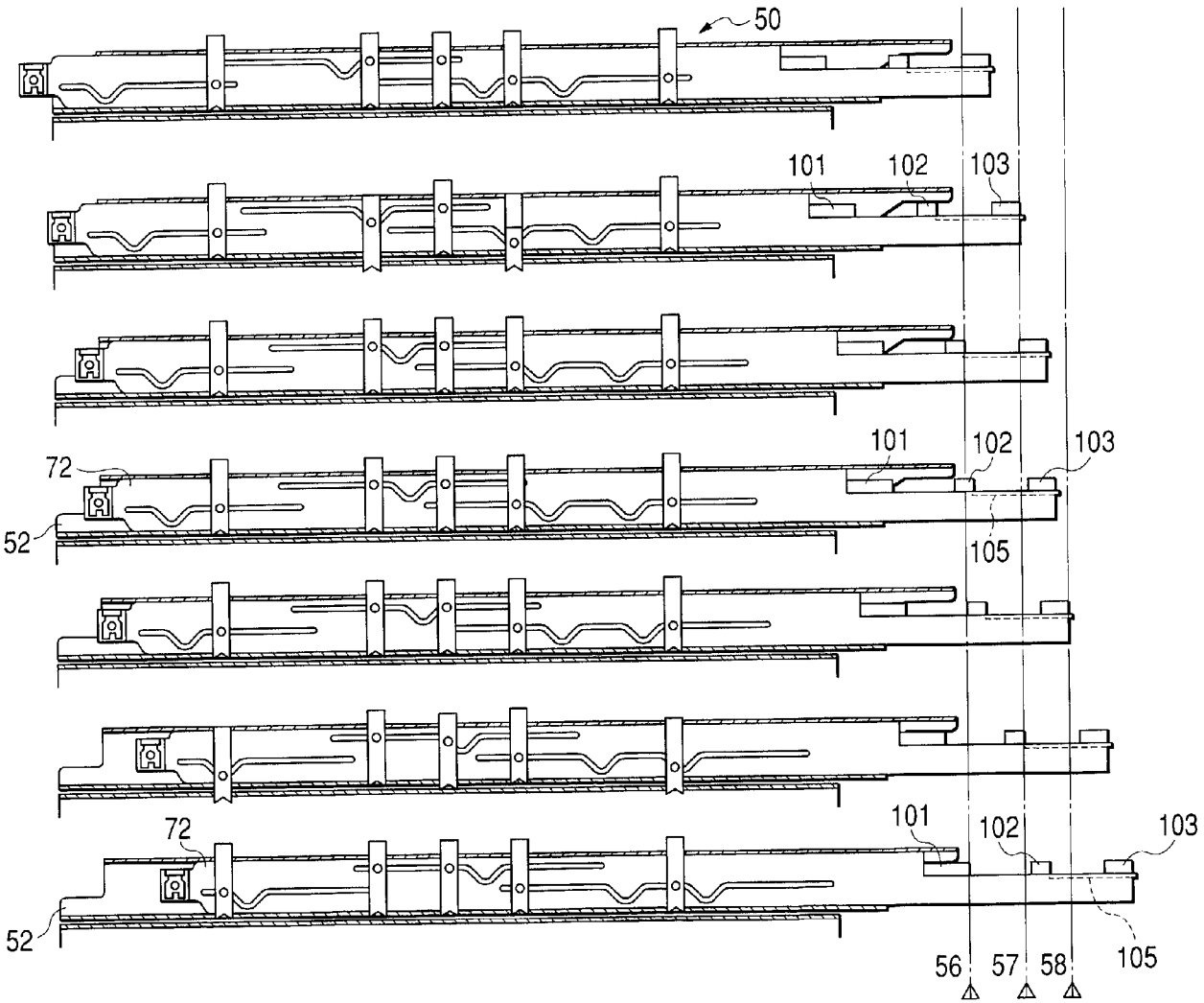
Figure 7:
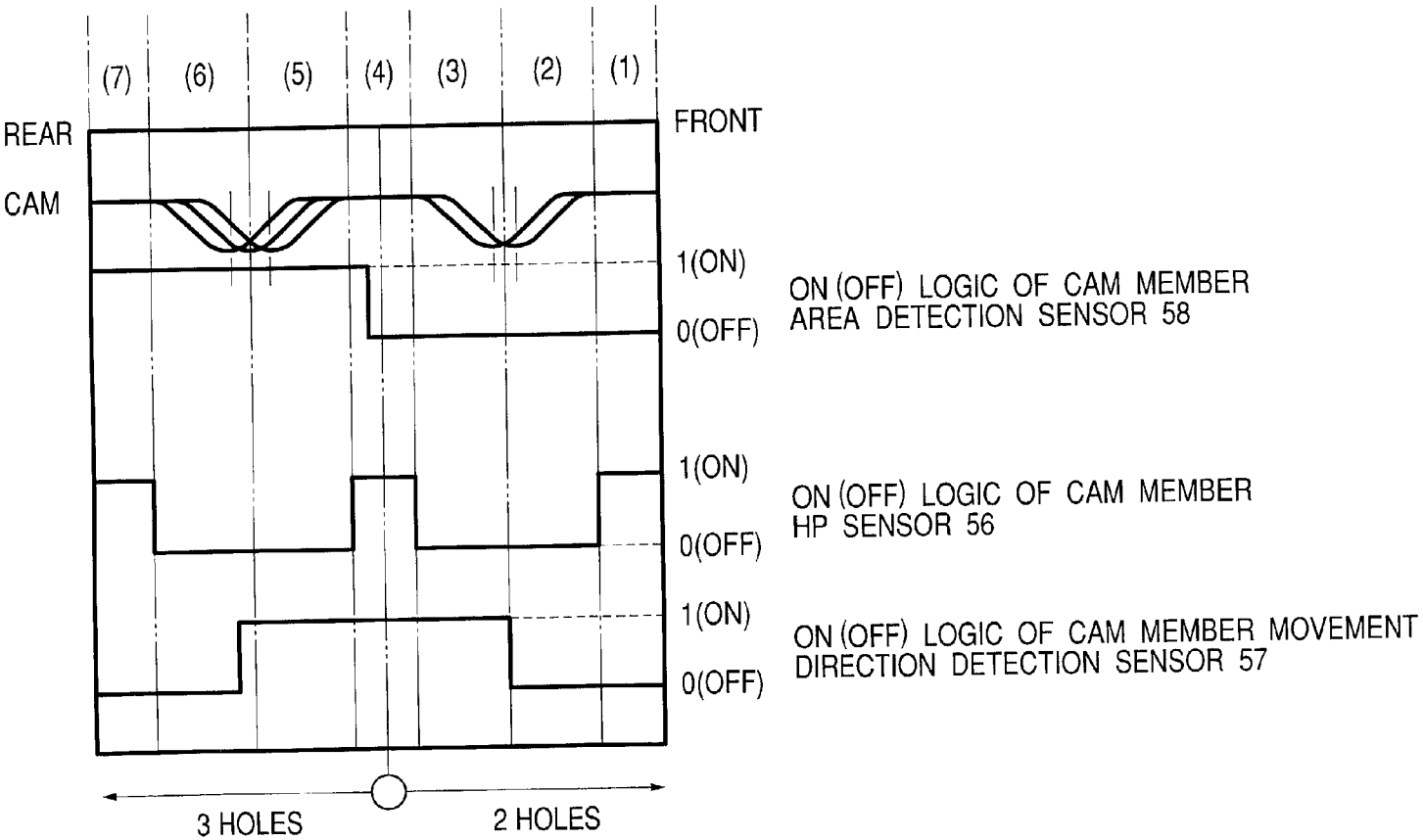
FIG. 7 is a diagram showing an ON/OFF logic of each cam member detection sensor.

For example, in a case where the state of the input from the cam member HP detection sensor 56 is OFF; the state of the input from the cam member movement direction detection sensor 57 is ON; and the state of the cam member area detection sensor 58 is ON, the cam member 72 is in a punching area (5) defined as shown in FIG. 7 and the punching device 50 is in the state shown in FIG. 6F. As shown in FIG. 7, there are seven areas occupied by the cam member 72. Selection of a destination to which the cam member 72 should be made to move in the initializing operation depends on the initial area.

FIG. 10 shows a matrix designating a destination according to the states of the inputs from the cam member HP detection sensor 56, the cam member movement direction detection sensor 57, and the cam member area detection sensor 58. For example, if the initial area is a rest area (1) or a punching area (2) in the areas shown in FIG. 7, the cam member 72 is moved to a rest area (4). If the initial area is a punching area (3), the cam member 72 is moved to the rest area (1). If the initial area is the rest area (4) or the punching area (5), the cam member 72 is moved to a rest area (7). If the initial area is the punching area (6) or the rest area (7), the cam member 72 is moved to the rest area (4).

Thus, a destination in the initializing operation is determined from the matrix (S702). After determination of a destination, the controller 110 sends a control signal to the motor driver 114 for driving the cam member drive motor 92 (S703).

The control signal for driving the cam member drive motor 92 includes a motor ON signal, a motor normal/reverse rotation signal, and a motor reverse rotation signal. If the number designating the area selected as a destination is larger than that designating the initial area, the cam member 72 is moved from left to right as viewed in FIGS. 6A to 6G. In this case, the level of the motor normal/reverse rotation signal is 1 (H level) and the controller 110 causes the motor shaft to move clockwise. If the number designating the area selected as a destination is smaller than that designating the initial area, the cam member 72 is moved from right to left as viewed in FIGS. 6A to 6G. In this case, the level of the motor normal/reverse rotation signal is 0 (L level) and the controller 110 causes the motor shaft to move counterclockwise.

If a target rotational speed of the cam member drive motor 92 is V1 (which is also a target speed of movement of the cam member 72 since the gear ratio of the rack 91 and the pinion 94 is 1:1), the controller 110 performs rotational speed control of the cam member drive motor 92 so that the rotational speed of the motor 92 becomes equal to the target speed V1. To perform this control, the controller 110 detects the input pulse signal from the cam member FG sensor 59 and performs pulse width modulation (PWM) control of the motor ON signal.

After starting driving the cam member drive motor 92, the controller 110 starts counting up a timer count T1 with a timer (S704). The controller 110 then determines whether timer count T1<300 msec (S705). If T1<300 msec, the controller 110 then determines whether the cam member HP detection sensor 56 has become ON (S706). If the cam member HP detection sensor 56 is ON, the controller 110 determines that the cam member 72 has moved to the HP area, and stops the cam member drive motor 92 by stopping transmitting the control signal for driving the cam member drive motor 92 to the motor driver 114 (S707). If the cam member HP detection sensor 56 is still OFF, the controller 110 returns the process to step S705 and again performs monitoring of T1.

If timer count T1≧300 msec in step S705, the controller 110 determines that the cam member 72 cannot reach the HP area due to occurrence of some abnormality in the operation of the cam member drive motor 92 or in the movement of the cam member 72, and determines this condition as an error of drive of the cam member drive motor 92 has occurred (S709). When such a drive error occurs, the controller 110 stops the punching device 50 to prevent any damage to the punching device 50, and displays information indicating the drive error on a display panel (not shown) provided on the sheet processor or the copying machine main unit 2 (S710). The controller 110 thus completes the initializing operation (S708).

While the initializing operation of the punching device having three HP areas has been described, the initializing operation of a punching device having two HP areas can be performed in the same manner. That is, in a punching device having two HP areas, the cam member 72, whose operation can be described with respect to the areas shown in FIG. 7, is moved through the range from the rest area (1) to the rest area (4) or through the range from the rest area (4) to the rest area (7). The matrix shown in FIG. 10 can also apply in this case.

More specifically, in the case of a punching device in which the cam member 72 is moved through the range from the rest area (1) to the rest area (4), the cam member 72 is moved to the rest area (4) if it is initially located in the rest area (1) or in the punching area (2), and is moved to the rest area (1) if it is initially located in the punching area (3) or in the rest area (4).

In the case of a punching device in which the cam member 72 is moved through the range from the rest area (4) to the rest area (7), the cam member 72 is moved to the rest area (7) if it is initially located in the rest area (4) or in the punching area (5), and is moved to the rest area (4) if it is initially located in the punching area (6) or in the rest area (7).

According to the matrix shown in FIG. 10, in the initializing operation of the punching devices having three HP areas, the cam member 72 is moved to the rest area (4) if the initial area is the rest area (1) or the punching area (2), is moved to the rest area (1) if the initial area is the punching area (3) or the rest area (4), is moved to the rest area (7) if the initial area is the rest area (4) or the punching area (5), and is moved to the rest area (4) if the initial area is the punching area (6) or the rest area (7), that is, the cam member 72 is moved to the area remoter than the closet area. The cam member 72 is not moved to the rest area (1) when the initial area is the rest area (1) or the punching area (2), is not moved to the rest area (4) when the initial area is the punching area (3) or the rest area (4), is not moved to the rest area (4) when the initial area is the rest area (4) or the punching area (5), and is not moved to the rest area (7) when the initial area is the punching area (6) or the rest area (7). That is, the cam member 72 is not moved to the closer area. The reason for moving the cam member to the remoter area is as described below.

The cam member drive motor 92 is stopped after the cam member state detection flags 101, 102, 103, and 105 provided on the cam member 72 have been detected by the cam member HP detection sensor 56, the cam member movement direction detection sensor 57, and the cam member area detection sensor 58. Therefore, the cam member cannot be stopped in the desired area unless it always passes the sensors with the same inertia. If the cam member 72 is moved to the closer area, it must be stopped immediately. However, the inertia of the cam member 72 thus moved is not always the same.

If the inertia is not always the same, the cam member 72 cannot be stopped at the target area with accuracy, that is, initialization cannot be performed with the desired accuracy. For this reason, the cam member 72 is stopped after being moved through a certain distance, thereby ensuring that the inertia of the cam member 72 when the cam member drive motor 92 is stopped is substantially the same no matter which initial area the cam member 72 has started moving from. The lengths of the cams 73A, 73B, 73C, 73D, and 73E formed in the cam member 72 are utilized to enable movement of the cam member 72 through a certain distance, thereby avoiding increasing the overall size of the punching device.

The same can also be said with respect to the initializing operation of the punching devices having only two HP areas.

Referring again to FIG. 8, after the initializing operation (S602) has been completed, a job start signal is transmitted from the control device 14 (see FIG. 1) in the copying machine main unit 2 to the processing control device 46 for controlling the punching device 50. Simultaneously, sheet size information designating the size of a sheet conveyed from the copying machine main unit 2 to the punching device 50 is transmitted to the processing control device 46. Sheet size information is transmitted each time a sheet is conveyed from the copying machine main unit 2. The controller 110 receives sheet size information (S604) and determines whether the size designated by the sheet size data is a punchable sheet size (S605). The sheet size data includes sheet length data L and sheet width data W. For example, if the sheet length data L received is L=200 and the sheet width data W is W=148, and if this size is not a punchable sheet size, the controller 110 does not permit execution of the punching operation and punching is not performed. The controller 10 then obtains the next sheet size data.

If the sheet size data obtained in step S605 designates a punchable sheet size, the controller 110 checks the cam member 72 area. The result of the above-described initializing operation (S602) must be that the cam member 72 has been moved to the rest area (1), the rest area (4) or the rest area (7) shown in FIG. 7. That is, the controller 110 determines the location of the cam member 72 in one of the rest area (1), the rest area (4), and the rest area (7) shown in FIG. 7. This determination is made through detection of the ON/OFF state of the cam member HP detection sensor 56 (S606).

If no determination result indicating the location of the cam member 72 in one of the rest area (1), the rest area (4), and the rest area (7) is obtained, it is not possible to assure the desired result of the punching operation, and the controller 110 determines that an error of drive of the cam member drive motor 92 has occurred (S617). When such a drive error occurs, the controller 110 stops the punching device 50 to prevent any damage to the punching device 50, and displays information indicating the drive error on the display panel (not shown) provided on the sheet processor or the copying machine main unit 2 (S618). If it is determined in S606 that the cam member 72 is in one of the rest area (1), the rest area (4), and the rest area (7), the controller 110 advances the process to the next step of determining the sheet width (S607).

In the sheet width determination step S607, detection is performed with a sensor (not shown) to determine whether the sheet width data W in the sheet size data obtained in step S604 is within the range defined by 266<W<298. If the sheet width data W is 266<W<298, the controller 110 determines that the sheet size designated by the sheet size data is the size of a sheet in which three holes are to be punched. If the sheet width data W is out of the range, the controller 110 determines that the sheet size designated by the sheet size data is the size of a sheet in which two holes are to be punched. Three holes may be also punched in a case where the sheet width data is 266<W.

If the result of sheet width determination in step S607 is that the sheet width data W is 266<W<298, the controller 110 determines whether the cam member 72 is in one of the areas in which it can be operated to punch three holes (S608). For example, if the controller 110 determines that the cam member 72 is in the rest area (4) or the rest area (7) shown in FIG. 7, it starts a three holes punching operation (S610), which is described below. If the controller 110 determines in step S608 that the cam member 72 is in the rest area (1) shown in FIG. 7, it performs two holes/three holes switching operation (S609), which is also described below, since three holes punching cannot be directly started.

Further, if the result of sheet width determination in step S607 is that the sheet width data W is out of the range 266<W<298, the controller 110 determines whether the cam member 72 is in one of the areas in which it can be operated to punch two holes (a first number of holes (or a second number of holes)) (S612). For example, if the controller 110 determines that the cam member 72 is in the rest area (1) or the rest area (4) shown in FIG. 7, it starts a two holes punching operation (S614), which is described below. If the controller 110 determines in step S612 that the cam member 72 is in the rest area (7) shown in FIG. 7, it performs three holes/two holes switching operation (S613), which is also described below, since two holes punching cannot be directly started.

After the punching operation has been performed, the controller determines whether there is a job continuation signal from the control device 14 (see FIG. 1) in the copying machine main unit 2 to the processing control device 46 for controlling the punching device 50 (S615). If there is a job continuation signal, the controller 110 returns the process to step S604 to obtain sheet size data designating the size of the next sheet (S604). If the controller 110 determines in step S615 that there is no job continuation signal, it recognizes the end of the job and terminates the sequential punching process (S616).

(Three Holes Punching Operation)

Figure 11:
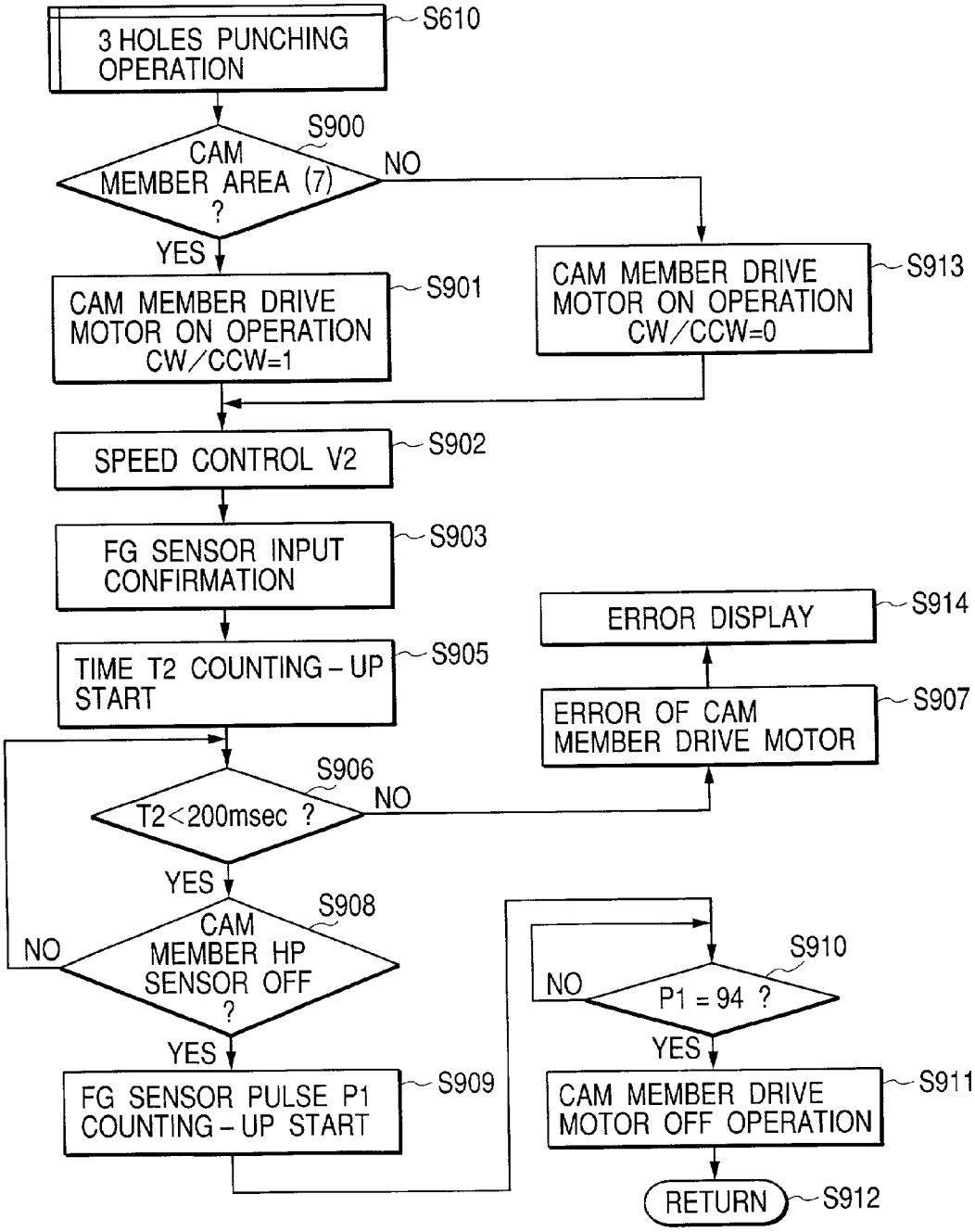
FIG. 11 is a flowchart of a three holes punching operation of the punching device in the embodiment of the present invention.

The operation for punching three holes (the second number of holes (or the first number of holes)) in a sheet will be described with reference to the flowchart of FIG. 11.

(Three Holes Punching Normal Rotation Control)

When a sheet P is conveyed to the punching device, it is guided into the gap S. Thereafter, the operation of the pair of rollers (not shown) conveying the sheet P is stopped to set the sheet in such a position that the end of the sheet on the upstream side faces the punches 68A, 68B, 68C, 68D, and 68E. At this time, if the cam member 72 is in the rest area (7) shown in FIG. 7 (S900), it is in the state of being shifted rightward relative to the movable frame 52, as shown in FIG. 6G.

To enable punching of holes in the sheet, it is necessary to move the cam member 72 leftward from the right-hand position. The controller 110 controls the cam member drive motor 92 so that the cam member 72 moves from right to left as viewed in FIG. 6G. Control for moving the cam member 72 such as moving from the rest area (7) toward the rest area (4) will be referred to as three holes normal rotation control.

In step S610, when conveyance of sheet P by the pair of rollers (not shown) is stopped, the controller 110 sends a control signal to the motor driver 114 for driving the cam member drive motor 92 (S901). The control signal for driving the cam member drive motor 92 comprises a motor ON signal, a motor normal/reverse rotation signal, and a motor reverse rotation signal. In the case of normal rotation control, the level of the motor normal/reverse rotation signal is 1 (H level) and the motor shaft is rotated clockwise.

If a target rotational speed of the cam member drive motor 92 is V2 (which is also a target speed of movement of the cam member 72), the controller 110 performs rotational speed control of the cam member drive motor 92 (S902)

through PWM control of the motor ON signal so that the rotational speed of the cam member drive motor 92 becomes equal to the target speed V2. The controller 110 performs this control by detecting the input pulse signal from the cam member FG sensor 59 (S903).

After starting driving the cam member drive motor 92, the controller 110 starts counting up by a timer count T2 (S905). This counting-up of timer count T2 is performed for the purpose of detecting a failure in the operation of the cam member drive motor 92. While processing is continued in step S905 and subsequent steps, the timer and the controller 110 always monitor the cam member drive motor 92 in cooperation with each other. If T2≧200 msec (S906), the controller 110 determines that the operation of the cam member drive motor 92 has ended in failure due to occurrence of some abnormality in the operation of the cam member drive motor 92 or in the movement of the cam member 72, and determines this condition as an error of drive of the cam member drive motor 92 (S907). When such a drive error occurs, the controller 110 stops the punching device 50 to prevent any damage to the punching device 50, and displays information indicating the drive error on the display panel (not shown) provided on the sheet processor or the copying machine main unit 2 (S914).

As the cam member drive motor 92 rotates, the cam member 72 is moved from right to left in the order of FIG. 6G, FIG. 6F, FIG. 6E, and FIG. 6D by means of the pinion 93 and the rack 91. With this movement, the punches 68A, 68B, and 68C for punching there holes are moved downward by the three-holes punching cams 73A, 73B, and 73C to punch three holes in the sheet and are then moved upward.

The controller 110 then waits for turning-off of the cam member HP detection sensor 56 (S908). When the cam member HP detection sensor 56 becomes OFF in step S908, the controller 110 starts counting-up the number of pulses P1 from the cam member FG sensor 59 (S909). When during the advancement of motor drive the number of pulses P1 from the cam member FG sensor 59 becomes, for example, P1=94 (S910), the controller 110 stops the drive control signal to the cam member drive motor 92, thereby stopping the cam member drive motor 92 (S911).

The number of pulses, which is 94, at which the cam member drive motor 92 is stopped by the controller 110 is selected by considering mechanical variations in the punching device 50 and variations in motor characteristics. That is, the number of pulses is set to such a number that the cam member 72 can be reliably stopped within the rest area (4) shown in FIG. 7. During counting-up to this number, the cam member HP detection sensor 56 becomes temporarily "OFF" from the state of being turned "ON" by the punching operation state detection flag 101 at the left end in the three punching operation state detection flags 101, 102, and 103, and is thereafter returned to the "ON" state by the central punching state detection flag 102.

Even if the cam member drive motor is turned OFF, the cam member 72 stop timing is adjusted by factoring in the inertia of the cam member drive motor 92, the inertia of the cam member 72, etc., so that the cam member 72 is stopped with the cam member HP detection sensor 56 correctly facing the central punching operation state detection flag 102 (the cam member 72 in the rest area (4) shown in FIG. 7) (S912).

(Three Holes Punching Reverse Rotation Control)

When a sheet P is conveyed to the punching device, it is guided into the gap S. Thereafter, the operation of the pair of rollers (not shown) conveying the sheet P is stopped to set the sheet in such a position that the end of the sheet on the upstream side faces the punches 68A, 68B, 68C, 68D, and 68E. At this time, if the cam member 72 is in the rest area (4) shown in FIG. 7, it is in the state of being shifted leftward relative to the movable frame 52, as shown in FIG. 6D.

To enable punching of holes in the sheet, it is necessary to move the cam member 72 rightward from the left-hand position. The controller 110 controls the cam member drive motor 92 so that the cam member 72 moves from left to right as viewed in FIG. 6D. Control for moving the cam member 72 such as moving from the rest area (4) toward the rest area (7) will be referred to as three holes reverse rotation control.

In step S610, when conveyance of sheet P by the pair of rollers (not shown) is stopped, the controller 110 sends a control signal to the motor driver 114 for driving the cam member drive motor 92 (S901). The control signal for driving the cam member drive motor 92 comprises a motor ON signal, a motor normal/reverse rotation signal, and a motor reverse rotation signal. In the case of normal rotation control, the level of the motor normal/reverse rotation signal is 0 (L level) and the motor shaft is rotated counterclockwise.

If a target rotational speed of the cam member drive motor 92 is V2 (which is also a target speed of movement of the cam member 72), the controller 110 performs rotational speed control of the cam member drive motor 92 (S902) through PWM control of the motor ON signal so that the rotational speed of the cam member drive motor 92 becomes equal to the target speed V2. The controller 110 performs this control by detecting the input pulse signal from the cam member FG sensor 59 (S903).

After starting driving the cam member drive motor 92, the controller 110 starts counting up by a timer count T2 (S905). This counting-up of timer count T2 is performed for the purpose of detecting a failure in the operation of the cam member drive motor 92. While processing is continued in step S905 and subsequent steps, the timer and the controller 110 always monitor the cam member drive motor 92 in cooperation with each other. If T2≧200 msec (S906), the controller 110 determines that the operation of the cam member drive motor 92 has ended in failure due to occurrence of some abnormality in the operation of the cam member drive motor 92 or in the movement of the cam member 72, and determines this condition as an error of drive of the cam member drive motor 92 (S907). When such a drive error occurs, the controller 110 stops the punching device 50 to prevent any damage to the punching device 50, and displays information indicating the drive error on the display panel (not shown) provided on the sheet processor or the copying machine main unit 2 (S914).

As the cam member drive motor 92 rotates, the cam member 72 is moved from left to right in the order of FIG. 6D, FIG. 6E, FIG. 6F, and FIG. 6G by means of the pinion 93 and the rack 91. With this movement, the punches 68A, 68B, and 68C for punching three holes are moved downward by the three-holes punching cams 73A, 73B, and 73C to punch three holes in the sheet and are then moved upward.

The controller 110 then waits for turning-off of the cam member HP detection sensor 56 (S908). When the cam member HP detection sensor 56 becomes OFF in step S908, the controller 110 starts counting-up the number of pulses P1 from the cam member FG sensor 59 (S909). When during the advancement of motor drive the number of pulses P1 from the cam member FG sensor 59 becomes, for example, P1=94 (S910), the controller 110 stops the drive control signal to the cam member drive motor 92, thereby stopping the cam member drive motor 92 (S911).

The number of pulses, which is 94, at which the cam member drive motor 92 is stopped by the controller 110 is selected by considering mechanical variations in the punching device 50 and variations in motor characteristics. That is, the number of pulses is set to such a number that the cam member 72 can be reliably stopped within the rest area (7) shown in FIG. 7. During counting-up this number, the cam member HP detection sensor 56 becomes temporarily "OFF" from the state of being turned "ON" by the central punching operation state detection flag 102 in the three punching operation state detection flags 101, 102, and 103, and is thereafter returned to the "ON" state by the punching operation state detection flag 101 at the left end.

Even if the cam member drive motor 92 is turned OFF, the cam member 72 stop timing is adjusted by factoring in the inertia of the cam member drive motor 92, the inertia of the cam member 72, etc., so that the cam member 72 is stopped with the cam member HP detection sensor 56 correctly facing the punching operation state detection flag 101 at the left end (the cam member 72 in the rest area (7) shown in FIG. 7) (S912).

(Two Holes Punching Operation)

Figure 12:
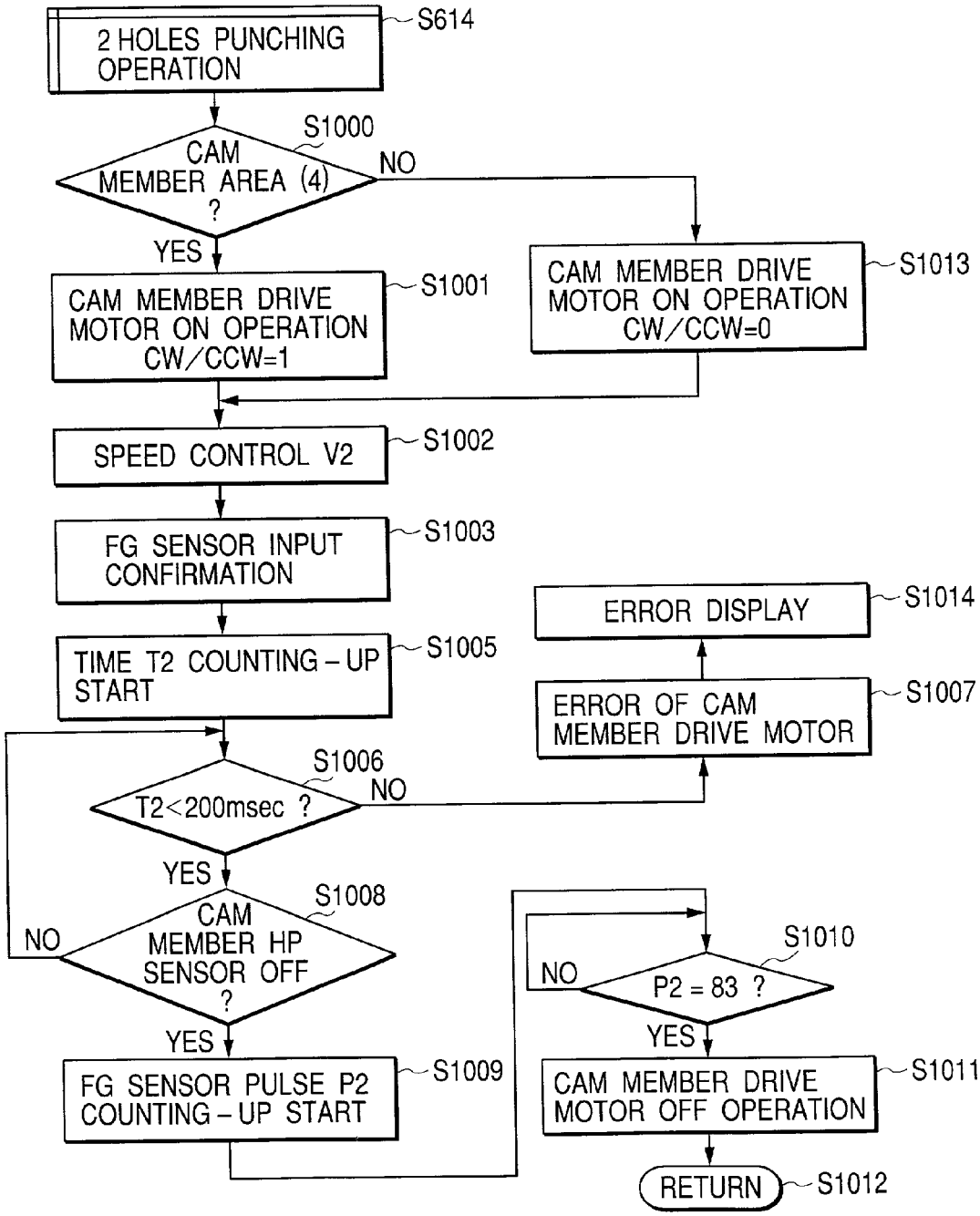
FIG. 12 is a flowchart of a two holes punching operation of the punching device in the embodiment of the present invention.

The operation for punching two holes in a sheet will be described with reference to the flowchart of FIG. 12.

(Two Holes Punching Normal Rotation Control)

When a sheet P is conveyed to the punching device, it is guided into the gap S. Thereafter, the operation of the pair of rollers (not shown) conveying the sheet P is stopped to set the sheet in such a position that the end of the sheet on the upstream side faces the punches 68A, 68B, 68C, 68D, and 68E. At this time, if the cam member 72 is in the rest area (4) shown in FIG. 7 (S1000), it is in the state of being shifted rightward relative to the movable frame 52, as shown in FIG. 6D.

To enable punching of holes in the sheet, it is necessary to move the cam member 72 leftward from the right-hand position. The controller 110 controls the cam member drive motor 92 so that the cam member 72 moves from right to left as viewed in FIG. 6D. Control for moving the cam member 72 such as moving from the rest area (4) toward the rest area (1) will be referred to as two holes normal rotation control.

In step S614, when conveyance of sheet P by the pair of rollers (not shown) is stopped, the controller 110 sends a control signal to the motor driver 114 for driving the cam member drive motor 92 (S1001). The control signal for driving the cam member drive motor 92 comprises a motor ON signal, a motor normal/reverse rotation signal, and a motor reverse rotation signal. In the case of normal rotation control, the level of the motor normal/reverse rotation signal is 1 (H level) and the motor shaft is rotated clockwise.

If a target rotational speed of the cam member drive motor 92 is V2 (which is also a target speed of movement of the cam member 72) (S1002), the controller 110 performs rotational speed control of the cam member drive motor 92 (S1002) through PWM control of the motor ON signal so that the rotational speed of the cam member drive motor 92 becomes equal to the target speed V2. The controller 110 performs this control by detecting the input pulse signal from the cam member FG sensor 59 (S1003).

After starting driving the cam member drive motor 92, the controller 110 starts counting up by a timer count T2 (S1005). This counting-up of timer count T2 is performed for the purpose of detecting a failure in the operation of the cam member drive motor 92. While processing is continued in step S1005 and subsequent steps, the timer and the controller 110 always monitor the cam member drive motor 92 in cooperation with each other. If T2≧200 msec (S1006), the controller 110 determines that the operation of the cam member drive motor 92 has ended in failure due to occurrence of some abnormality in the operation of the cam member drive motor 92 or in the movement of the cam member 72, and determines this condition as an error of drive of the cam member drive motor 92 (S1007). When such a drive error occurs, the controller 110 stops the punching device 50 to prevent any damage to the punching device 50, and displays information indicating the drive error on the display panel (not shown) provided on the sheet processor or the copying machine main unit 2 (S1014).

As the cam member drive motor 92 rotates, the cam member 72 is moved from right to left in the order of FIG. 6D, FIG. 6C, FIG. 6B, and FIG. 6A by means of the pinion 93 and the rack 91. With this movement, the punches 68D and 68E for punching two holes are moved downward by the two-holes punching cams 73D and 73E to punch two holes in the sheet and are then moved upward.

The controller 110 then waits for turning-off of the cam member HP detection sensor 56 (S1008). When the cam member HP detection sensor 56 becomes OFF in step S1008, the controller 110 starts counting-up the number of pulses P2 from the cam member FG sensor 59 (S1009). When during the advancement of motor drive the number of pulses P2 from the cam member FG sensor 59 becomes, for example, P2=83 (S1010), the controller 110 stops the drive control signal to the cam member drive motor 92, thereby stopping the cam member drive motor 92 (S1011).

The number of pulses, which is 83, at which the cam member drive motor 92 is stopped by the controller 110 is selected by considering mechanical variations in the punching device 50 and variations in motor characteristics. That is, the number of pulses is set to such a number that the cam member 72 can be reliably stopped within the rest area (1) shown in FIG. 7. During counting-up to this number, the cam member HP detection sensor 56 becomes temporarily "OFF" from the state of being turned "ON" by the central punching operation state detection flag 102 in the three punching operation state detection flags 101, 102, and 103, and is thereafter returned to the "ON" state by the punching operation state detection flag 103 at the right end.

Even if the cam member drive motor 92 is turned OFF, the cam member 72 stop timing is adjusted by factoring in the inertia of the cam member drive motor 92, the inertia of the cam member 72, etc., so that the cam member 72 is stopped with the cam member HP detection sensor 56 correctly facing the punching operation state detection flag 103 at the right end (the cam member 72 in the rest area (1) shown in FIG. 7) (S1012).

(Two Holes Punching Reverse Rotation Control)

When a sheet P is conveyed to the punching device, it is guided into the gap S. Thereafter, the operation of the pair of rollers (not shown) conveying the sheet P is stopped to set the sheet in such a position that the end of the sheet on the upstream side faces the punches 68A, 68B, 68C, 68D, and 68E. At this time, if the cam member 72 is in the rest area (1) shown in FIG. 7 (S1000), it is in the state of being shifted leftward relative to the movable frame 52, as shown in FIG. 6A.

To enable punching of holes in the sheet, it is necessary to move the cam member 72 rightward from the left-hand position. The controller 110 controls the cam member drive motor 92 so that the cam member 72 moves from left to right as viewed in FIG. 6A. Control for moving the cam member 72 such as moving from the rest area (1) toward the rest area (4) will be referred to as two holes reverse rotation control.

In step S614, when conveyance of sheet P by the pair of rollers (not shown) is stopped, the controller 110 sends a control signal to the motor driver 114 for driving the cam member drive motor 92 (S1001). The control signal for driving the cam member drive motor 92 comprises a motor ON signal, a motor normal/reverse rotation signal, and a motor reverse rotation signal. In the case of normal rotation control, the level of the motor normal/reverse rotation signal is 0 (L level) and the motor shaft is rotated counterclockwise.

If a target rotational speed of the cam member drive motor 92 is V2 (which is also a target speed of movement of the cam member 72) (S1002), the controller 110 performs rotational speed control of the cam member drive motor 92 (S1002) through PWM control of the motor ON signal so that the rotational speed of the cam member drive motor 92 becomes equal to the target speed V2. The controller 110 performs this control by detecting the input pulse signal from the cam member FG sensor 59 (S1003).

After starting driving the cam member drive motor 92, the controller 110 starts counting up by a timer count T2 (S1005). This counting-up of timer count T2 is performed for the purpose of detecting a failure in the operation of the cam member drive motor 92. While processing is continued in step S1005 and subsequent steps, the timer and the controller 110 always monitor the cam member drive motor 92 in cooperation with each other. If T2≧200 msec (S1006), the controller 110 determines that the operation of the cam member drive motor 92 has ended in failure due to occurrence of some abnormality in the operation of the cam member drive motor 92 or in the movement of the cam member 72, and determines this condition as an error of drive of the cam member drive motor 92 (S1007). When such a drive error occurs, the controller 110 stops the punching device 50 to prevent any damage to the punching device 50, and displays information indicating the drive error on the display panel (not shown) provided on the sheet processor or the copying machine main unit 2 (S1014).

As the cam member drive motor 92 rotates, the cam member 72 is moved from left to right in the order of FIG. 6A, FIG. 6B, FIG. 6C, and FIG. 6D by means of the pinion 93 and the rack 91. With this movement, the punches 68D and 68E for punching two holes are moved downward by the two-holes punching cams 73D and 73E to punch two holes in the sheet and are then moved upward.

The controller 110 then waits for turning-off of the cam member HP detection sensor 56 (S1008). When the cam member HP detection sensor 56 becomes OFF instep S1008, the controller 110 starts counting-up the number of pulses P2 from the cam member FG sensor 59 (S1009). When during the advancement of motor drive the number of pulses P2 from the cam member FG sensor 59 becomes, for example, P2=83 (S1010), the controller 110 stops the drive control signal to the cam member drive motor 92, thereby stopping the cam member drive motor 92 (S1011).

The number of pulses, which is 83, at which the cam member drive motor 92 is stopped by the controller 110 is selected by considering mechanical variations in the punching device 50 and variations in motor characteristics. That is, the number of pulses is set to such a number that the cam member 72 can be reliably stopped within the rest area (4) shown in FIG. 7. During count to this number, the cam member HP detection sensor 56 becomes temporarily "OFF" from the state of being turned "ON" by the punching operation state detection flag 103 at the right end in the three punching operation state detection flags 101, 102, and 103, and is thereafter returned to the "ON" state by the central punching operation state detection flag 102.

The cam member 72 stop timing is adjusted by factoring in the inertia of the cam member drive motor 92, the inertia of the cam member 72, etc., so that the cam member 72 is stopped with the cam member HP detection sensor 56 correctly facing the central punching state detection flag 102 (the cam member 72 in the rest area (4) shown in FIG. 7) (S1012).

(Two Holes/Three Holes Switching Operation)

The operation for switching the number of holes to be punched in a sheet from two to three will be described with reference to the flowchart of FIG. 13.

In the case where three holes punching operation in step S610 shown in FIG. 8 is continued, that is, the sheet width size data checked in step S607 is unchanged, punching of three holes in a sheet in the above-described manner can be repeated by reciprocating the cam member 72 between the rest area (4) and the rest area (7) shown in FIG. 7. Similarly, in the case of two holes punching, punching of two holes in a sheet can be repeated by reciprocating the cam member 72 between the rest area (1) and the rest area (4) shown in FIG. 7.

Therefore, if in step S607 the sheet width size data is changed from a value out of the range 266<W<298 to a value within the range 266<W<298, it is necessary to change the punching mode from two holes punching operation to three holes punching operation.

Figure 13:
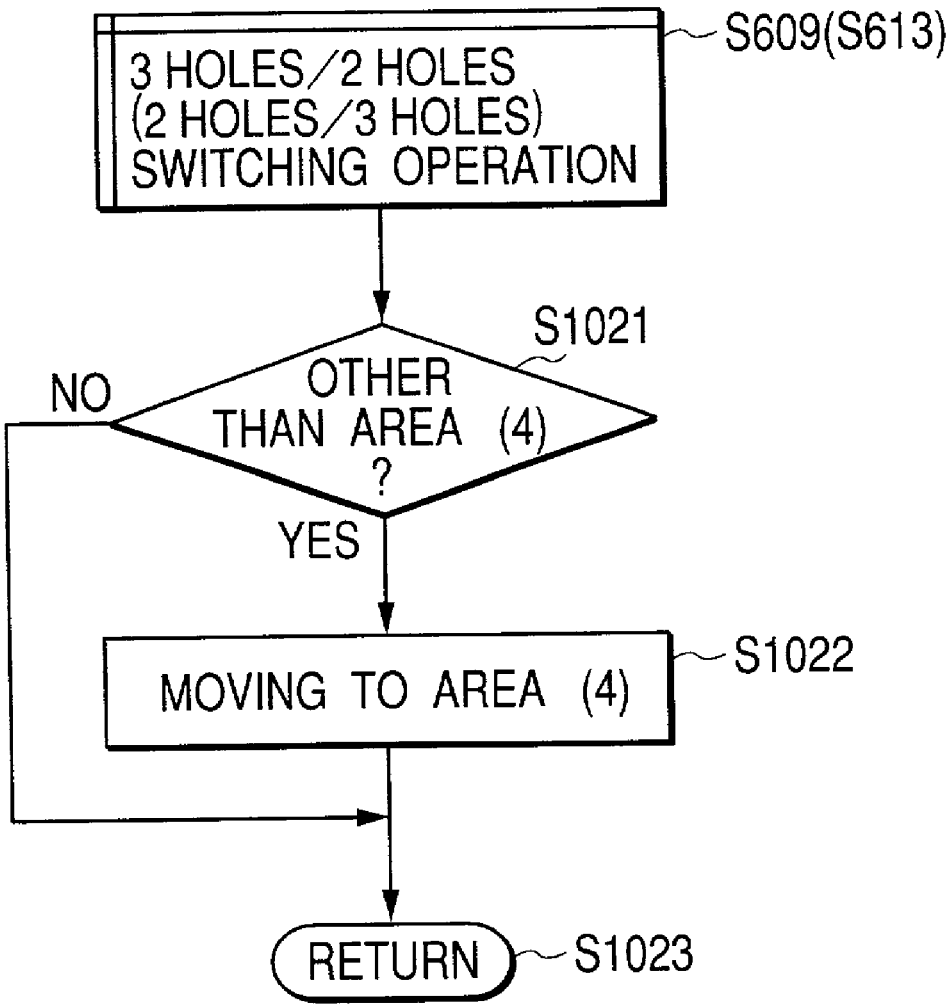
FIG. 13 is a flowchart of a two holes/three holes switching operation of the punching device in the embodiment of the present invention.

Referring to FIG. 13, if the cam member 72 is located in one of the areas other than the rest area (4) shown in FIG. 7 (S1021), it is moved to the rest area (4) shown in FIG. 7 (S1022). If the cam member 72 is located in the rest area (4) shown in FIG. 7, it is not moved from the rest area (4) since it can be immediately operated for either two holes or three holes punching operation from the rest area (4). The cam member control method for moving the cam member from the rest area (7) to the rest area (4) is the same as that for the above-described two holes reverse rotation operation.

(Three Holes/Two Holes Switching Operation)

Conversely, if in step S607 the sheet width size data is changed from a value within the range 266<W<298 to a value out of the range 266<W<298, it is necessary to change the punching mode from three holes punching operation to two holes punching operation.

Referring to FIG. 13, if the cam member 72 is located in one of the areas other than the rest area (4) shown in FIG. 7 (S1021), it is moved to the rest area (4) shown in FIG. 7 (S1022). If the cam member 72 is located in the rest area (4) shown in FIG. 7, it is not moved from the rest area (4) since it can be immediately operated for either two holes or three holes punching operation from the rest area (4). The cam member control method for moving the cam member from the rest area (1) to the rest area (4) is the same as that for the above-described two holes reverse rotation operation.

In the above-described arrangement, each punch 68 is moved by the cam 73 moving integrated in the cam member 72 (operating means). Alternatively, each punch 68 may be connected by a link (not shown) to a moving plate which is provided in place of the cam member, and which functions like the cam member to move the punch 68. In this case, the moving plate and the link constitute an operating means.

The punching device in this embodiment of the present invention is arranged to punch holes in a sheet by using the movement of the cam member in a direction intersecting the direction of movement of each punch, or by using the movement of a moving plate. Then, the device thus simply constructed can quickly punch holes in a sheet.

The copying machine having the punching device of this embodiment capable of quickly punching holes in a sheet can speedily provide a user with a sheet on which an image is formed.

Also, the sheet processor having the punching device of this embodiment capable of quickly punching holes in a sheet can speedily provide a user with a sheet on which an image is formed.

The reason for setting the target speed V1 of the cam member drive motor 92 (corresponding to the target speed of movement of the cam member 72) in the initializing operation to a value lower than the target speed V2 of the cam member 72 in the punching operation in the above description is as described below.

The area in which the cam member 72 is stopped immediately before the initializing operation is performed is not fixed. The distance through which the cam member 72 is moved from the area in which it has been stopped to the area in which it is stopped at the end of the initializing operation varies on a case-by-case basis. It is difficult to control stopping of the cam member 72 through the rotation of the cam member drive motor 92, which is a pulse motor. In view of this problem, the cam member 72 is stopped after the cam member drive motor 92 is stopped upon detecting the cam member state detection flags 101, 102, 103, and 105 provided on the cam member 72 by means of the cam member HP detection sensor 56, the cam member movement direction detection sensor 57, and the cam member area detection sensor 58. Therefore, if the speed of movement of the cam member 72 is increased, the distance through which the cam member 72 moves until the time at which the motor is stopped is increased by the inertia of the cam member 72. In such a case, the time required to thereafter start the punching operation is increased. For this reason, the speed of the cam member drive motor 92 in the initializing operation is reduced to reduce the speed of movement of the cam member 72.

On the contrary, in the case of the punching operation, the distance between one of the rest areas to another of the rest areas via the target punching area is known before the cam member 72 is moved. Therefore, by detecting the number of revolutions of the cam member drive motor 92 and by factoring in the inertia of the cam member drive motor 92, the inertia of the cam member 72, etc., the cam member drive motor 92 may be stopped immediately before the cam member 72 reaches the rest area after passing the target punching area. Consequently, the target speed V2 of the cam member drive motor 92 in the punching operation is set higher than the target speed V1 in the initializing operation to improve the punching efficiency.

How the rest areas and punching areas in the appended claims corresponds to the rest areas and punching areas in the above-described embodiment (see FIG. 7) will be described.

If the rest area (1) in the embodiment is assumed to correspond to the first rest area in claims 1 and 2, the first punching area, the second punching area, and the second rest area in the claims correspond to the punching area (2), the punching area (3), and the rest area (4) in the embodiment.

If the rest area (4) in the embodiment is assumed to correspond to the first rest area in claims 1 and 2, the first punching area, the second punching area, and the second rest area in the claims correspond to the punching area (3), the punching area (2), and the rest area (1), or to punching area (5), the punching area (6), and the rest area (7) in the embodiment.

If the rest area (7) in the embodiment is assumed to correspond to the first rest area in claims 1 and 2, the first punching area, the second punching area, and the second rest area in the claims correspond to the punching area (6), the punching area (5), and the rest area (4) in the embodiment.

If the rest area (1) in the embodiment is assumed to correspond to the first rest area in claims 3 and 4, the first punching area, the second punching area, the second rest area, the third punching area, the fourth punching area, and the third rest area in the claims correspond to the punching area (2), the punching area (3), the rest area (4), the punching area (5), the punching area (6), and the rest area (7) in the embodiment.

If the rest area (7) in the embodiment is assumed to correspond to the first rest area in claims 3 and 4, the first punching area, the second punching area, the second rest area, the third punching area, the fourth punching area, and the third rest area in the claims correspond to the punching area (6), the punching area (5), the rest area (4), the punching area (3), the punching area (2), and the rest area (1) in the embodiment.

The first movement area in the claims is, for example, an area for punching two (or three) holes in a sheet, and the second movement area is an area for punching three (or two) holes in a sheet. That is, different numbers of holes are punched through the first and second movement areas. The number of holes punched through each of the first and second movement areas is not limited to two or three. Accordingly, the number of holes punched by the punching device is not limited to two or three.

What is claimed is:

1. A punching device comprising:

a die member having a plurality of die holes formed therein;

a plurality of punch members which are adapted to advance into the die holes to punch holes in a sheet;

an operating member having cam portions, said operating member being moved along the direction intersecting the direction of advancement of said punch members to cause said punch members to advance into the die holes by said cam portion;

detection means for detecting the position of said operating member;

a drive motor; and control means for operating said drive motor so as to control movement of said operating member wherein said control means operates said drive motor to perform an initializing operation for moving said operating member to a first rest position or to a second rest position before said control means operates said drive motor to perform a punching operation for punching holes in the sheet while moving said operating member between said first rest position and said second rest position, wherein in said initializing operation (i) said operating member is moved to the first rest position when said detection means detects that said operating member is present in a position nearer to the second rest position than the first rest position, and (ii) said operating member is moved to the second rest position when said detection means detects that said operating member is present in a position nearer to the first rest position than the second rest position.

2. A punching device according to claim 1, wherein each of said cam portions has a straight groove and a cam groove for advancing said punch members into said die holes, and wherein, when said operating member is moved in one of opposite directions, at least one of said cam grooves of said cam portions acts on one of said punch members to selectively cause the same to advance.

3. A punching device according to claim 2, wherein one of said cam portions has two cam grooves at its center, and straight grooves formed at opposite ends of each cam groove, and is used to control two of said punch members.

4. A punching device according to claim 2, wherein one of said cam portions has one cam groove at its center, and straight grooves formed at opposite ends of the cam groove, and is used to control two of said punch members.

5. A punching device according to claim 2, wherein one of said cam portions has one cam groove at its end, and a straight groove formed at an end of the cam groove, and is used to control one of said punch members.

6. A punching device according to claim 2, wherein:

one of said cam portions has two cam grooves at its center, and straight grooves formed at opposite ends of each cam groove, and is used to control two of said punch members;

another of said cam portions has one cam groove at its center, and straight grooves formed at opposite ends of the cam groove, and is used to control two of said punch members; and a remaining one of said cam portions has one cam groove at its end, and a straight groove formed at an end of the cam groove, and is used to control one of said punch members, two of said punch members and three of said punch members being selectively caused to advance.

7. A punching device according to claim 1, wherein:

said operating member can be moved between the first rest position and the second rest position on the basis of a detection operation performed by said detection means.

8. A punching device according to claim 7, wherein said control means stops said operating member if said detection means does not detect the movement of said operating member after a lapse of a predetermined period of time from the time at which said control means starts the operation of said operating member.

9. A punching device according to claim 8, wherein the predetermined period of time in the case of the initializing operation is longer than that in the case of the punching operation.

10. A punching device according to claim 1, wherein said operating member is movable in a moving area sectioned in order of a first rest area having the first rest position, a first punching area, a second punching area, and a second rest area having the second rest position, wherein said operation control means performs the initializing operation in which said operating member is moved to the second rest area when said operating member is located in the first rest area or in the first punching area, and said operating member is moved to the first rest area when said operating member is located in the second rest area or in the second punching area.

11. A punching device according to claim 1, wherein a speed of the movement of said operating member in the initializing operation is lower than that in the punching operation.

12. A sheet processor comprising a punching device for punching holes in the sheet according to claim 1.

13. An image forming apparatus comprising:

image forming means for forming an image on a sheet; and a punching device for punching holes in the sheet according to claim 1.

14. A punching device according to claim 1, wherein a third rest position is arranged on an opposite side of the first rest position with respect to the second rest position, and said operating member is movable in the first rest position, second rest position and the third rest position, and wherein said control means performs the initializing operation in which said operating member is moved to a secondary near rest position in the first, second and third rest positions.

15. A punching device according to claim 14, wherein said operating member is movable in a moving area sectioned in order of a first rest area having the first rest position, a first punching area, a second punching area, a second rest area having the second rest position, a third punching area, a fourth punching area, and a third rest area having a third rest position, wherein said control means performs the initializing operation in which said operating member is moved to the second rest area when said operating member is located in the first rest area or in the first punching area, said operating member is moved to the first rest area when said operating member is located in the second rest area or in the second punching area, said operating member is moved to the third rest area when said operating member is located in the second rest area or in the third punching area, and said operating member is moved to the second rest area when said operating member is located in the third rest area or in the fourth punching area.

16. A punching device according to claim 14, wherein said operating member is movable between said first and third rest positions under the control of said control means;

said operating member punches a first number of holes in the member to be punched with the corresponding number of said punch member when said operating member performs a punching operation for causing the corresponding number of said punch members to advance into the corresponding die holes during its movement from the first rest position to the second rest position or its movement from the second rest position to the first rest position; and said operating member punches a second number of holes in the member to be punched with the corresponding number of said punch members when said operating member performs a punching operation for causing the corresponding number of said punch members to advance into the corresponding die holes during its movement from the second rest position to the third rest position or its movement from the third rest position to the second rest position.

17. A punching device according to claim 16, wherein a speed of the movement of said operating member in the initializing operation is lower than that in the punching operation.

18. A punching device comprising:

a die member having a plurality of die holes formed therein;

a plurality of punch members adapted to advance into the die holes to punch holes in a sheet to be punched;

an operating member which moves along a direction intersecting a direction of advancement of said punch members to advance said punch members into the die holes, wherein a moving area of said operating member is sectioned in the order of a first rest area, a first punching area, a second punching area, and a second rest area;

detection means for detecting the position of said operating member;

a drive motor; and control means for operating said drive motor to control movement of said operating member on the base of the detection of said detection means, wherein said control means operate said drive motor to control movement of said operating member to perform in the first punching area a punching operation for causing at least one of said punch members to advance into the corresponding die hole when moved from the first rest area to the second rest area, and performs in the second punching area a punching operation for causing said at least one of the punch members to advance into the corresponding die hole when moved from the second rest area to the first rest area, wherein, before said punching operation, said control means operates said drive motor to perform an initializing operation of (i) moving said operating member to the second rest area when it is detected by said detection means that said operating member is present in the first rest area or the first punching area and (ii) moving said operating member to the first rest area when it is detected by said detection means that said operating member is present in the second rest area or the second punching area.

19. A punching device comprising:

a die member having a plurality of die holes formed therein;

a plurality of punch members adapted to advance into the die holes to punch holes in a sheet to be punched;

an operating member which moves along a direction intersecting a direction of advancement of said punch members to advance said punch members into the die holes, wherein a moving area of said operating member is sectioned in the order of a first rest area, a first punching area, a second punching area, a second rest area, a third punching area, a fourth punching area, and a third rest area;

detection means for detecting the position of said operating member;

a drive motor; and control means for operating said drive motor to control movement of said operation member on the basis of the detection by said detection means, wherein said control means operates said drive motor to control movement of said operating member to punch a first number of holes in the sheet to be punched with the corresponding number of said punch members when said operating member performs in the first punching area a punching operation for causing the corresponding number of said punch members to advance into the corresponding die holes during its movement from the first rest area to the second rest area, and when said operating member performs in the second punching area a punching operation for causing the corresponding number of said punch members to advance into the corresponding die holes during its movement from the second rest area to the first rest area; and wherein said control means operates said drive motor to control movement of said operating member to punch a second number of holes in the sheet to be punched with the corresponding number of said punch members when said operating member performs in the third punching area a punching operation for causing the corresponding number of said punch members to advance into the corresponding die holes during its movement from the second rest area to the third rest area, and when said operating member performs in the fourth punching area a punching operation for causing the corresponding number of said punch members to advance into the corresponding die holes during its movement from the third rest area to the second rest area, wherein, before said punching operation, said control means operates said drive motor to perform an initializing operation of (i) moving said operating member to the second rest area when it is detected by said detection means that said operating member is present in the first rest area or the first punching area, (ii) moving said operating member to the first rest area when it is detected by said detection means that said operating member is present in the second rest area or the second punching area, (iii) moving said operating member to the third rest area when it is detected by said detection member that said operating means is present in the third punching area, and (iv) moving said operating member to the second rest area when it is detected by said detection means that said operating member is present in the third rest area or the fourth punching area.

* * * * *

UNITED STATES PATENT AND TRADEMARK OFFICE

CERTIFICATE OF CORRECTION

PATENT NO. : 7,073,706 B2
APPLICATION NO. : 10/091464
DATED : July 11, 2006
INVENTOR(S) : Masatoshi Yaginuma et al.

It is certified that error appears in the above-identified patent and that said Letters Patent is hereby corrected as shown below:

COVER PAGE AT ITEM (56) RC:
Foreign Patent Documents, "EP 067 973 A2 5/1982" should read --EP 067 973 A2 12/1982--.

COLUMN 8:
Line 39, "the" should read --three--.

COLUMN 10:
Line 55, "OFF;" should read --OFF,--.
Line 57, "ON;" should read --ON,--.

COLUMN 15:
Line 29, "there" should read --three--.

COLUMN 25:
Line 11, "operate" should read --operates--.

Signed and Sealed this

Sixth Day of March, 2007

JON W. DUDAS
*Director of the United States Patent and Trademark Office*